US012808269B2

(12) United States Patent
Johnsen

(10) Patent No.: US 12,808,269 B2
(45) **Date of Patent: *Nov. 24, 2026**

(54) SYSTEMS AND METHODS FOR HANDLING CONTROL LINES IN WELL OPERATIONS

(71) Applicant: STAVANGER ENGINEERING AS, Stavanger (NO)

(72) Inventor: Tomas Johnsen, Hafrsfjord (NO)

(73) Assignee: STAVANGER ENGINEERING AS, Stavanger (NO)

( * ) Notice: Subject to any disclaimer, the term of this patent is extended or adjusted under 35 U.S.C. 154(b) by 28 days.

This patent is subject to a terminal disclaimer.

(21) Appl. No.: 19/034,579

(22) Filed: Jan. 23, 2025

(65) Prior Publication Data

US 2025/0172048 A1 May 29, 2025

Related U.S. Application Data

(63) Continuation of application No. 18/567,028, filed as application No. PCT/NO2022/050130 on Jun. 7, 2022, now Pat. No. 12,241,318.

(30) Foreign Application Priority Data

Jun. 7, 2021 (NO) ..... 20210738
Jan. 11, 2022 (NO) ..... 20220040

(51) Int. Cl.
*E21B 19/22* (2006.01)

(52) U.S. Cl.
CPC ..... *E21B 19/22* (2013.01)

(58) Field of Classification Search
CPC ..... E21B 17/026; E21B 17/1035; E21B 19/22
See application file for complete search history.

(56) References Cited

U.S. PATENT DOCUMENTS 6,920,931 B1 7/2005 Webre et al.
7,216,716 B2 * 5/2007 Cole ..... E21B 17/026 166/380
9,598,914 B2 * 3/2017 Brown ..... E21B 19/00
12,241,318 B2 * 3/2025 Johnsen ..... E21B 17/026
2006/0090901 A1 5/2006 Pennison et al.
(Continued)

FOREIGN PATENT DOCUMENTS

GB 2 330 374 A 4/1999
IT UA 2016/3802 A1 11/2017
(Continued)

*Primary Examiner* — Matthew R Buck
(74) *Attorney, Agent, or Firm* — Norman B. Thot

(57) ABSTRACT

A control line handling apparatus includes a base, a guide head, and a clamp actuator head. The guide head has at least one guide slot which guides a control line. The guide head is arranged on a guide head actuator arm. The guide head actuator arm moves between a first, retracted guide head position where the guide head is spaced from a pipe string which extends vertically into a well, and a second, advanced guide head position where the guide head engages the pipe string. The clamp actuator head is arranged on a clamp head arm. The clamp head arm moves between a first, retracted clamp actuator head position where the clamp actuator head is spaced from the pipe string, and a second, advanced clamp actuator head position where the clamp actuator head engages the pipe string.

11 Claims, 22 Drawing Sheets

(56) References Cited

U.S. PATENT DOCUMENTS

| | | | | |
|---|---|---|---|---|
| 2008/0308281 | A1* | 12/2008 | Boutwell, Jr. | E21B 29/04 166/385 |
| 2012/0090828 | A1* | 4/2012 | Webre | E21B 17/026 29/428 |
| 2021/0003803 | A1* | 1/2021 | Park | E21B 17/026 |
| 2022/0120142 | A1* | 4/2022 | Jaaskelainen | B23K 20/10 |

FOREIGN PATENT DOCUMENTS

| | | | |
|---|---|---|---|
| NO | 328198 | B1 | 1/2010 |
| WO | WO 2005/071215 | A1 | 8/2005 |
| WO | WO 2014/133566 | A1 | 9/2014 |

* cited by examiner

SYSTEMS AND METHODS FOR HANDLING CONTROL LINES IN WELL OPERATIONS

CROSS REFERENCE TO PRIOR APPLICATIONS

This application is a continuation of application Ser. No. 18/567,028, filed on Dec. 5, 2023, which is a U.S. National Phase application U.S. National Phase application under 35 U.S.C. § 371 of International Application No. PCT/NO2022/050130, filed on Jun. 7, 2022 and which claims benefit to Norwegian patent application Ser. No. 20/210,738, filed on Jun. 7, 2021, and to Norwegian patent application Ser. No. 20/220,040, filed on Jan. 11, 2022. The International Application was published in English on Dec. 15, 2022 as WO 2022/260531 A1 under PCT Article 21(2).

FIELD

The present disclosure relates to systems and methods for handling control lines in well operations, including but not limited to positioning control lines adjacent a pipe string and/or fixing control lines to a pipe string.

BACKGROUND

In well operations, for example operations to prepare a petroleum well for operation or operating a petroleum well, there may be a need to position tools or equipment downhole, where such tools or equipment may require a supply of power or control signals from a surface location. For example, a downhole pump may be arranged to assist the production of petroleum products, with the pump being powered electrically from surface. One known way of providing such power or control signals is to fix a control line to an outside of a pipe string, for example a so-called tubing string, and run the pipe string with the control line into the well. The tool or equipment, such as an electrical submersible pump (ESP), may in such a case be positioned at a lower end of the pipe string.

An example of the general principles associated with such an operation is shown in U.S. Pat. No. 6,920,931 B1. Other documents which may be useful for understanding the field of technology include US 2008/00308281 A1 and WO 2014/133566 A1.

There is a continuous need for improved safety and efficiency for such well operations, in order to reduce cost, improve operational uptime and reduce risk of injuries or damage to personnel or equipment.

SUMMARY

An object of the present invention is to provide improved safety and efficiency for well operations in order to reduce cost, improve operational uptime and to reduce the risk of injuries or damage to personal or equipment, or at least to provide an alternative to previously described solutions.

In an embodiment, the present invention provides a control line handling apparatus which includes a base, a guide head, and a clamp actuator head. The guide head is arranged on a guide head actuator arm. The guide head actuator arm is configured to move between a first, retracted guide head position in which the guide head is configured to be spaced from a pipe string which extends vertically into a well, and a second, advanced guide head position in which the guide head is configured to engage the pipe string. The guide head comprises at least one guide slot which is configured to guide a control line. The clamp actuator head is arranged on a clamp head arm. The clamp head arm is configured to move between a first, retracted clamp actuator head position in which the clamp actuator head is configured to be spaced from the pipe string, and a second, advanced clamp actuator head position in which the clamp actuator head is configured to engage the pipe string.

BRIEF DESCRIPTION OF THE DRAWINGS

These and other characteristics will become clear from the following description of illustrative, non-restrictive examples, with reference to the attached drawings, in which.

DETAILED DESCRIPTION

Figure 1:
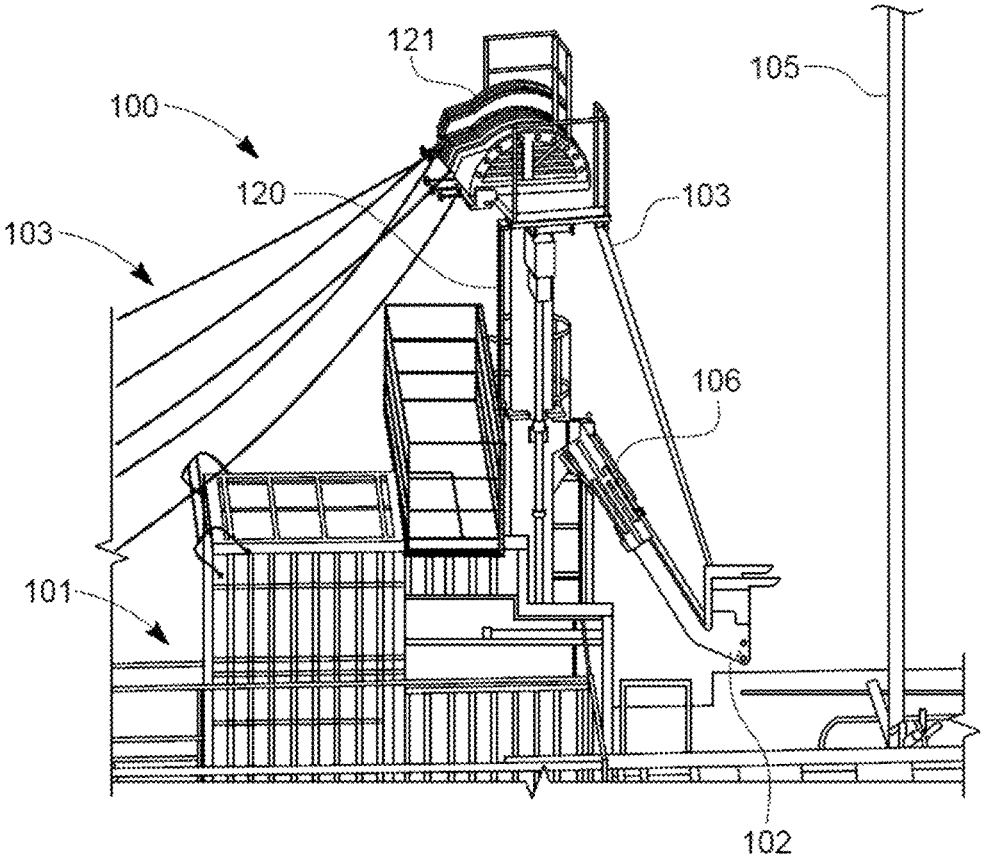
FIGS. 1-2 are perspective views of a control line handling apparatus.

The following description may use terms such as "horizontal", "vertical", "lateral", "back and forth", "up and down", "upper", "lower", "inner", "outer", "forward", "rear", etc. These terms generally refer to the views and orientations as shown in the drawings and that are associated with a normal use of the invention. The terms are used for the reader's convenience only and shall not be limiting.

Figure 2:
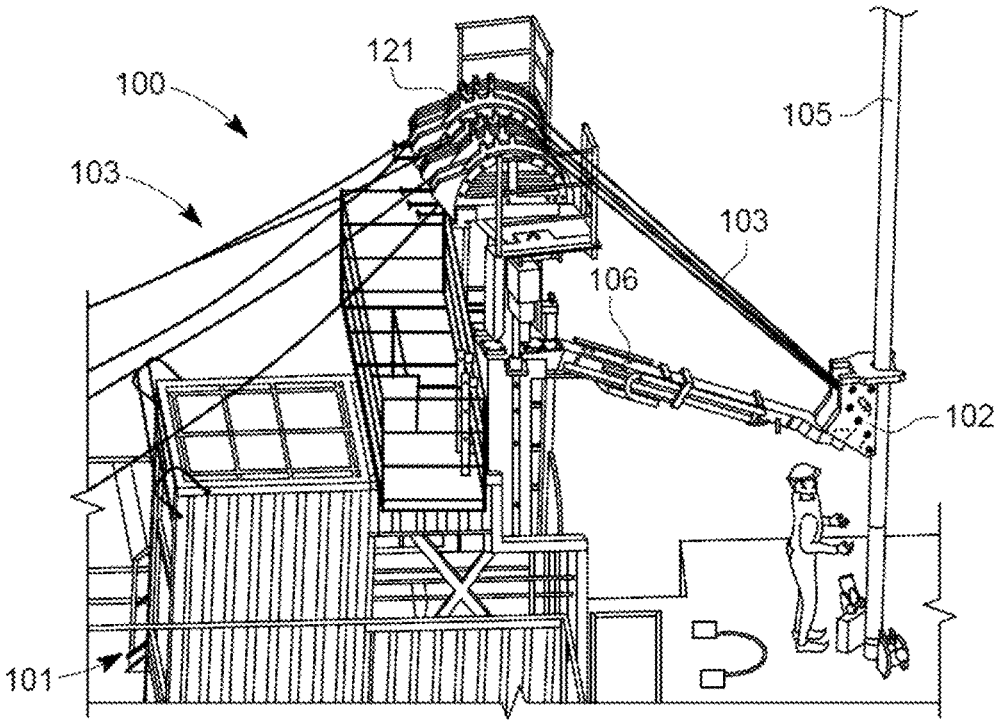

FIGS. 1 and 2 show a control line handling apparatus 100 according to an example. The control line handling apparatus 100 can be used to assist the handling of control lines 103 for fixing the control lines 103 to a pipe string 105, such as a tubing string, for lowering into a well through an opening on a drill floor. The control lines 103 may typically be provided from reels or the like (not shown). Although the control lines 103 are illustrated and described in the plural herein, it should be understood that in any example there may be only a single control line 103, if the operational requirements are such that only a single control line 103 is needed.

Figure 3:
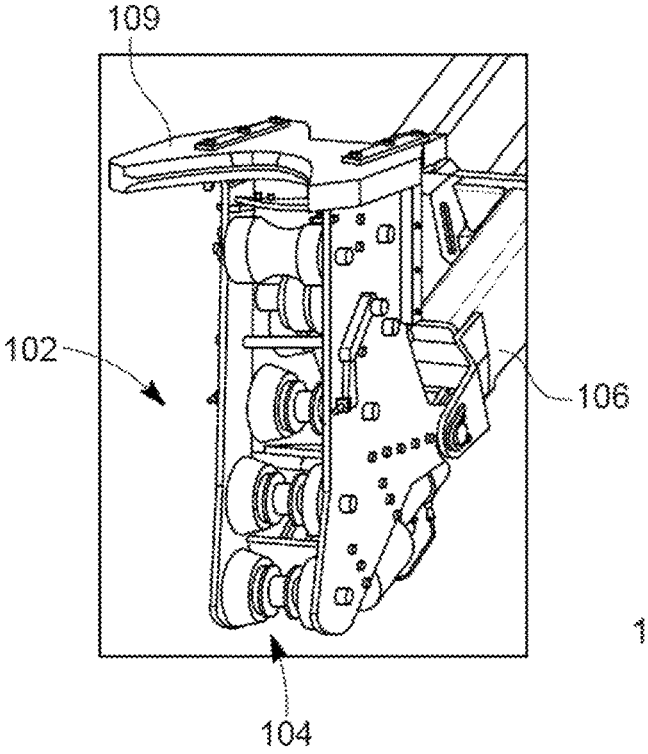
FIGS. 3-5 illustrate various details of the apparatus shown in FIGS. 1-2.
Figure 4:
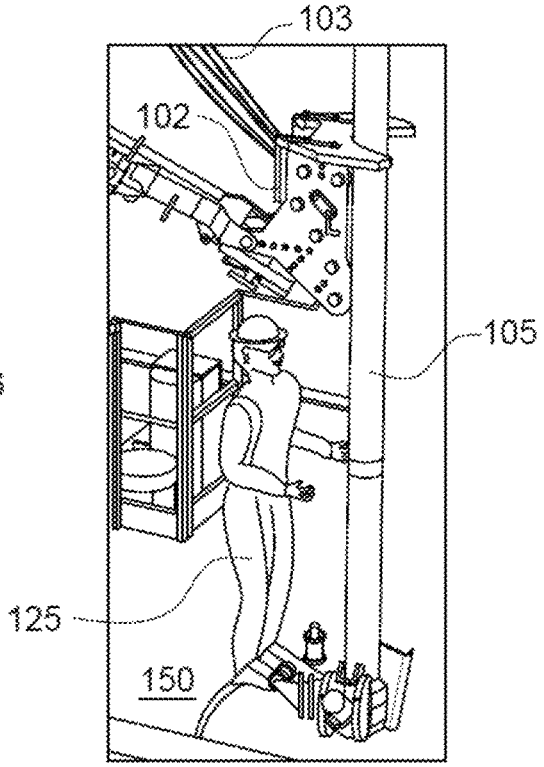
Figure 5:
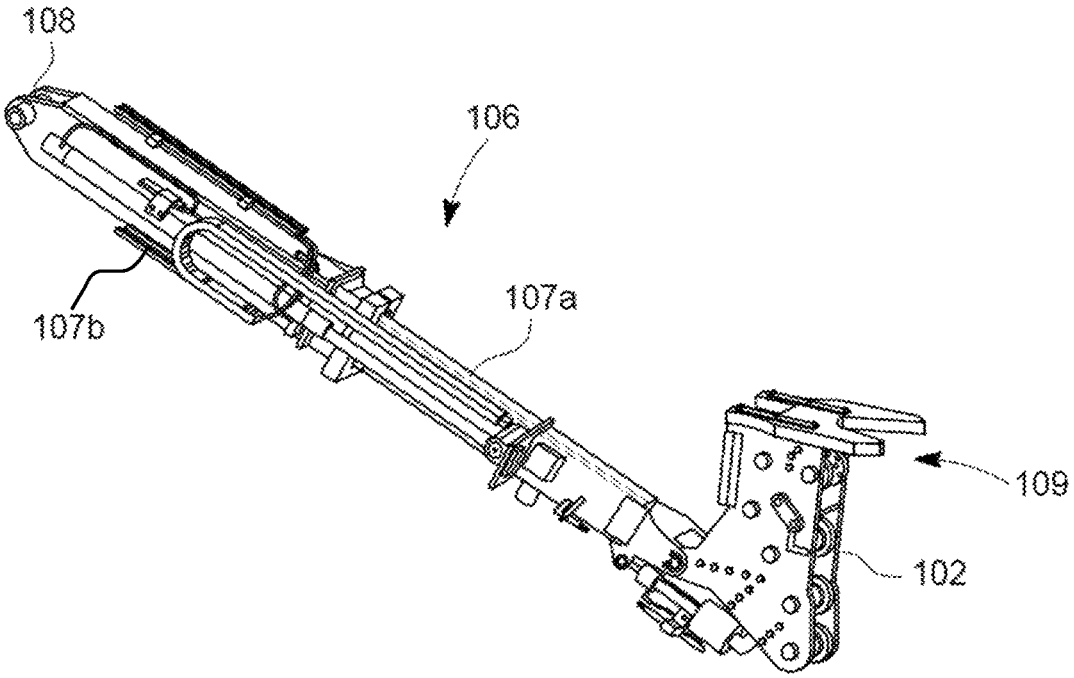

FIGS. 3-5 illustrate further detail of the apparatus 100 shown in FIGS. 1 and 2. The apparatus 100 comprises a base 101 (see FIGS. 1 and 2). An actuator arm 106 is operable to move a guide head 102 in relation to the base 101 between at least a first, retracted position and a second, advanced position. In the first, retracted position, the guide head 102 is spaced from the pipe string 105. This is illustrated in FIG. 1. In the second, advanced position, the guide head 102 is positioned adjacent the pipe string 105, as shown in FIGS. 2 and 4. The guide head 102 may advantageously be positioned in contact with the pipe string 105 in the second, advanced position.

Illustrated in FIG. 3, the movable guide head 102 comprises at least one guide slot 104 for guiding a control line 103. Advantageously, the guide head 102 comprises several guide slots or one guide slot capable of handling several control lines 103. The guide slots may be arranged partly or fully on rollers or the like in the guide head 102, such as to allow unhindered longitudinal movement of the control lines 103 while the control lines 103 are held in the guide slot(s) 104.

FIG. 5 illustrate the actuator arm 106 and guide head 102 in further detail. The actuator arm 106 may be telescopically extendable, for example having first and second telescopic parts 107*a,b* to permit extension and retraction of the arm 106. The arm 106 may, additionally or alternatively, be rotatably fixed to the base 101 via a pivotable connector 108 fixing the arm 106 to the base 101. (See also, for example, the description in relation to FIG. 12 below.) Advantageously, the pivotable connector 108 can be made vertically movable in relation to the base 101. In this manner, the vertical position of the arm 106 can be adjusted. Such vertical movement can, for example, be realized by means of a linear actuator, such as a threaded rod arrangement.

Advantageously, the pivotable connector 108 can be arranged vertically higher than the guide head 102. Particularly, the pivotable connector 108 can be arranged to be vertically higher than the guide head 102 in both the guide head's first, retracted position and its second, advanced position. In this manner, the arm 106 operates with an angle in relation to the drill floor, i.e. not parallel with the drill floor, in both the guide head's first, retracted position and its second, advanced position. Alternatively, the arm 106 can be arranged to be horizontal in at least the guide head's second, advanced position or, optionally, in both the guide head's first, retracted position and in its second, advanced position, as illustrated e.g. in FIG. 22 and described in further detail below.

As can be seen particularly in FIGS. 3 and 5, the guide head 102 may comprise a receptacle 109 configured for receiving the pipe string 105. The receptacle 109 can advantageously be a U-shaped or V-shaped recess for receiving the pipe string 105 therein. In this manner, the positioning of the guide head 102 in relation to the pipe string 105 can be improved and simplified, as can be seen in e.g. FIG. 4.

The control line handling apparatus 100 in this example further comprises a guide tower 120 having at least one line guide member 121 arranged at an upper part thereof. The guide tower 120 and at least one guide member 121 are arranged to guide the control lines 103 between a storage position (such as a control line reel) and the guide head 102/pipe string 105. The guide tower 120 and associated components are described further in relation to FIGS. 6-11, which show a similar example of a control line handling apparatus 100 as that shown in FIGS. 1-5.

Figure 6A:
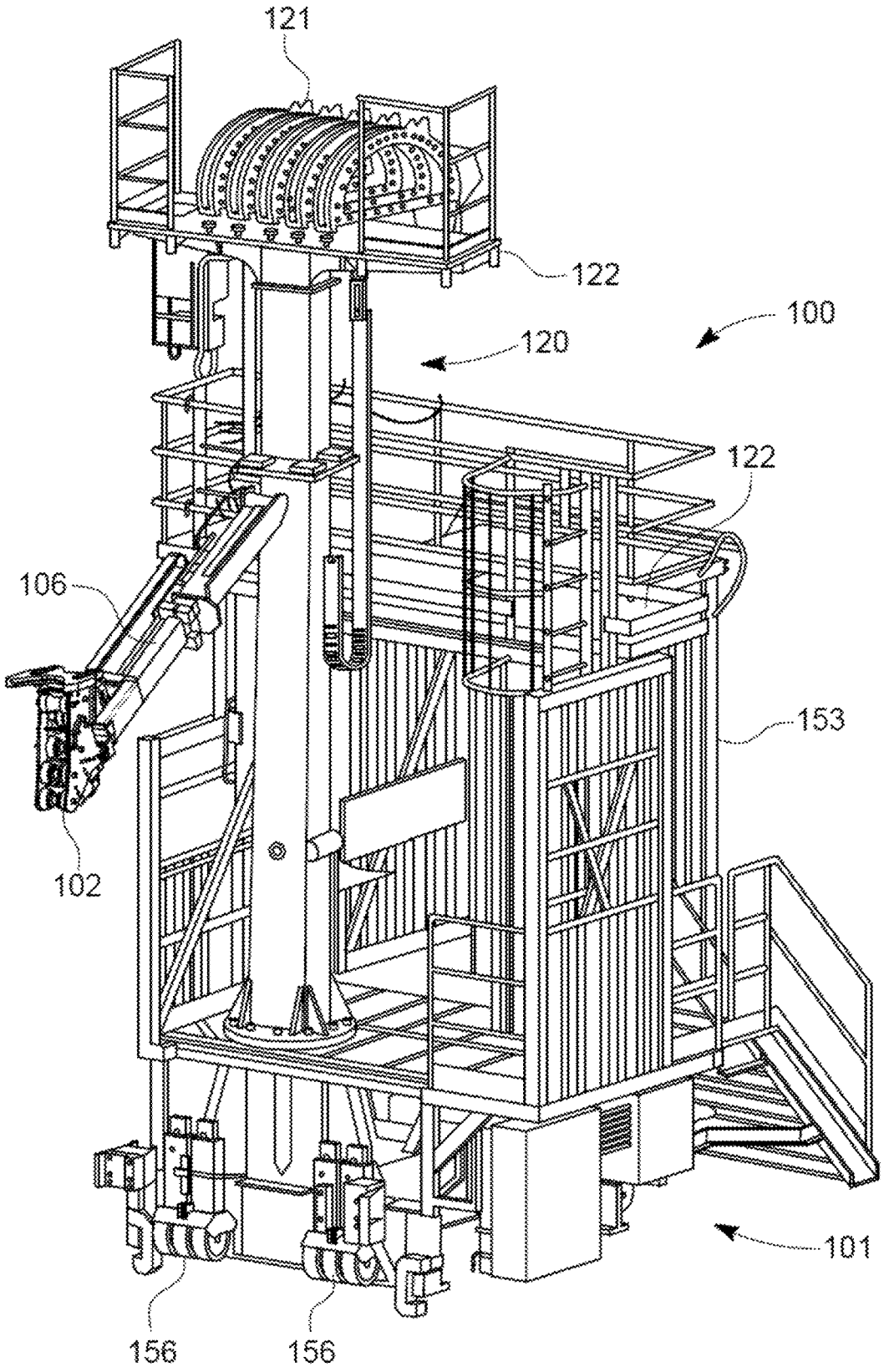
FIGS. 6-11 illustrate details of a control line handling apparatus similar to the example shown in FIGS. 1-2.

As shown in FIG. 6A, the guide tower 120 extends vertically upwardly from the base 101. The guide tower 120 may for this purpose be integral with the base 101, e.g. be in the form of an elongate structure flanged or welded onto the base 101. Advantageously, the guide tower 120 is extendible in a vertical direction, for example wherein the guide tower 120 is telescopically extendible in the vertical direction. This provides advantages in that the operational height of the guide tower 120 can be adjusted according to any prevailing requirements, for example in view of the distance between the base 101 and the pipe string 105, the available vertical space at the site, and/or in view of the type of control lines 103 used and the desirable angles for the control lines extending towards the guide head 102 and pipe string 105. The at least one guide member 121 can thus be arranged vertically higher than the guide head 102.

Also illustrated in FIG. 6A, the base 101 may comprise wheels 156 or the like for movement of the base 101. The wheels 156 may, for example, be retractable such as to lower the base 101 onto the underlying deck during operation. Providing the base 101 with wheels 156 or equivalent movement means, such as belts or skids, can allow the base 101 and the entire control line handling apparatus 100 to be move between different well slots on an installation or to be moved between installations. Alternatively, the control line handling apparatus 100 may be lifted, for example by a crane, for this purpose.

The arm 106 may be fixed to the guide tower 120, as illustrated in e.g. FIG. 6A. Alternatively, the arm 106 can be fixed to the base 101 separate from the guide tower 120.

The guide tower 120 or the base 101 can advantageously comprise a platform 122 on which the at least one line guide member 121 is arranged. Alternatively, or additionally, the platform 122 can provide access for an operator 125, such as a technician, to access the at least one line guide member 121. (See FIG. 10.) The platform 122 can be arranged on a vertically movable part of the guide tower 120, as illustrated in FIGS. 6A and 9, and/or on the base 101 or fixed relative to the base 101, as illustrated in FIGS. 6A and 10.

Figure 6B:
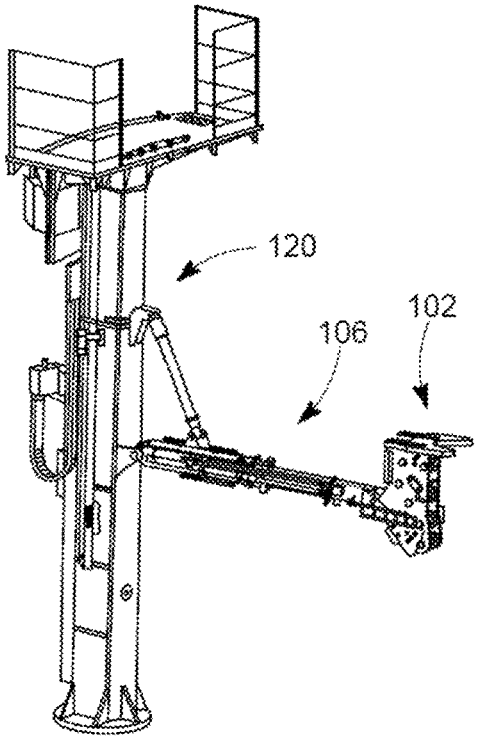
Figure 6C:
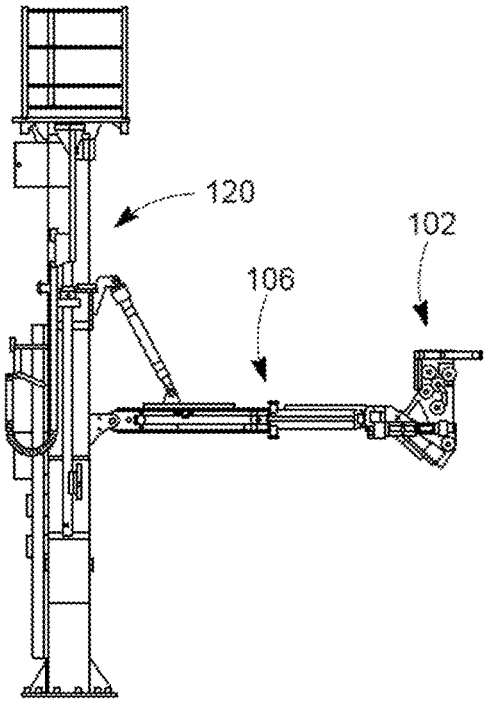

FIGS. 6B and 6C illustrate in a simplified manner a design in which the arm 106 is arranged substantially horizontally while operating, and where the guide head 102 is movable only horizontally between retracted and advanced positions. (As also discussed in further detail below, e.g. in relation to FIGS. 16-24.) This may provide advantages of simplified control. The arm 106 may, for example, have a parking position which is substantially vertical, along the guide tower 120 (see e.g. FIG. 9 and the corresponding discussion below). The arm 106 may then be extended to a horizontal operating position, as shown in FIGS. 6B and 6C, in which the guide head 102 is horizontally movable between advanced and retracted positions.

Figure 7:
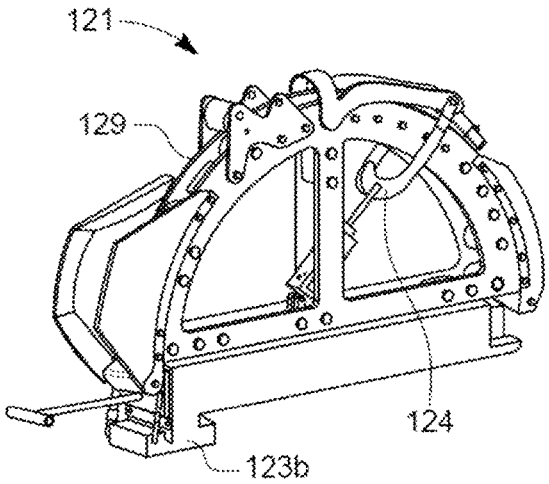
Figure 9:
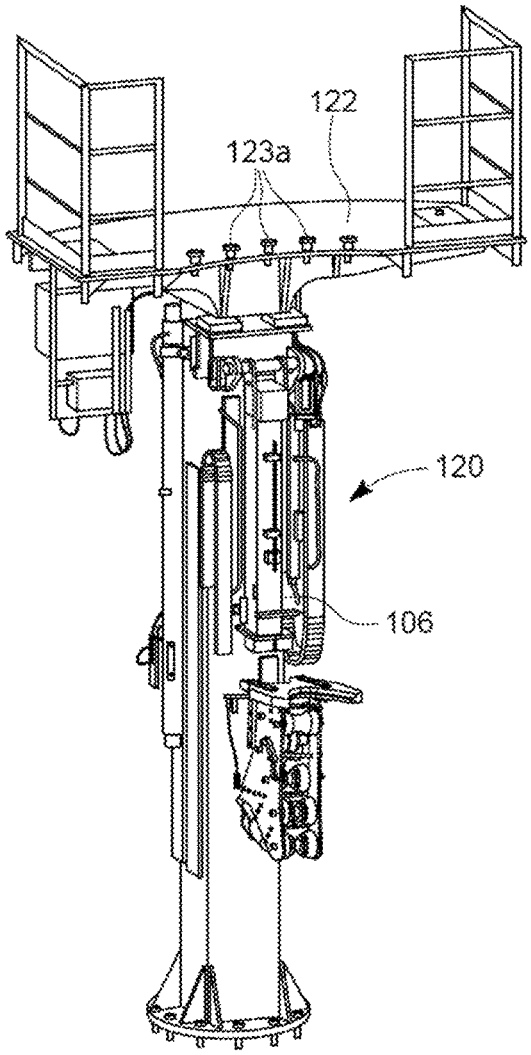
Figure 8:
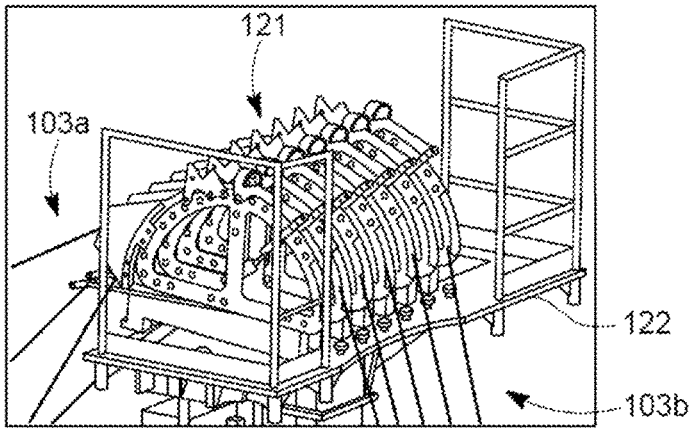
Figure 10:
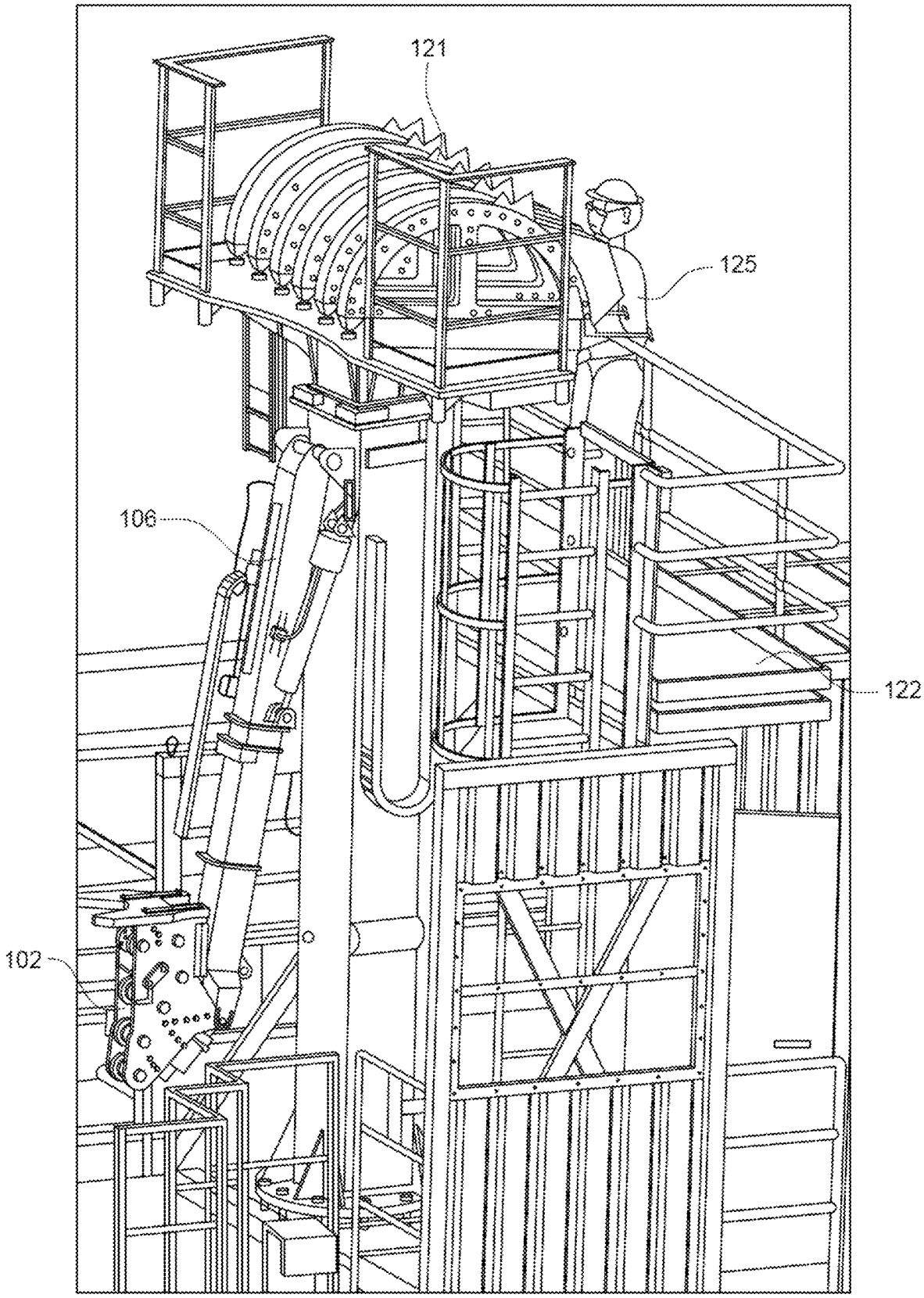

Illustrated in detail in e.g. FIGS. 7-9, but applicable to any example described herein, the guide member(s) 121 may comprise at least one sheave 129. The sheave(s) can have a curved portion for guiding the control line 103 along a plurality of rollers arranged at and along the curved portion, i.e. be a roller sheave (a so-called 'banana sheave' or 'banana block'), as illustrated most clearly in FIG. 7. Alternatively, the sheave(s) 129 may have only a single, larger sheave wheel over which the guide member(s) 121 run.

Advantageously, the at least one guide member 121 can comprise a brake 124 operable to engage the control line 103 or the sheave(s) 129 and provide a tensioning force onto the control line 103. The brake 124 may, for example, be a friction brake arranged on the sheave, which engages the control line 103 directly to provide a friction force and thereby controlling the tension in the control line 103 going out of the sheave and towards the guide head 102. Alternatively, or additionally, the brake 124 may be a brake or motorized drive (such as an electric motor) which operates on the sheave(s) or rollers, i.e. to control the rotational resistance and thereby create a tension force on the control line(s) 103 running over the sheave(s).

Allowing control of the tension in the control line(s) 103 can ensure that the control line(s) 103 maintain the correct position during the operations, for example to avoid slack in the control line(s) 103, while at the same time ensuring that the control line(s) 103 are not subjected to excessive loads, such as tensile loads.

The brake 124 may, in any of the examples or embodiments described herein, be a variable brake, i.e. a brake which is controllable and allows manual or automatic regulation of the braking force. The guide member(s) 121 can also be equipped with a load sensor, such as a force sensor, to measure the tension force applied on the control line(s) 103 at any given time. Such measurement may, for example, be done by measuring a downward force in a guide member connector 123*a,b* (described below). A feedback control loop can be used to regulate the brake to ensure a setpoint representing a desired tension value is maintained. Alternatively, the brake force can be passively controlled by design of the brake itself, for example by applying a friction brake which applies a given braking force up to a maximum value but allows the control line(s) 103 to run through the guide member(s) 121 if the maximum value is surpassed. In this manner, a substantially constant tension can be held in the control line(s) 103.

As illustrated in FIG. 8, the guide member(s) 121 may in this manner maintain a tension on the control line(s) 103 on the control line part(s) 103*b* which run out of the guide member(s) 121 and towards the guide head 102 and the pipe string 105. Tension in the "reel side" part 103*a* of the control line(s) 103 is in this respect less critical, and slack may be allowed (or even be desirable) on the control line(s) 103 in the part 103*a* running into the guide member(s) 121.

Advantageously, if also having the guide member(s) 121 height-adjustable, such as making the guide tower 120 telescopic or otherwise vertically extendible, control of both (i) the angles of the control line(s) 103 towards the guide head 102 and/or the pipe string 105, and (ii) the tension in the control line(s) 103 can be obtained. This provides benefits of enhanced operational control, to ensure smooth operations and avoid excessive loads, such as too high tensile and/or bending loads, on the control line(s) 103.

Illustrated in FIGS. 7 and 9, the guide member(s) 121 can be connected to the guide tower 120 via a guide member connector 123*a,b* which provides a pivotable connection about a vertical axis. This can provide advantages if, for example, the control line(s) 103 enter the guide member(s) 121 from different angles, for example if control line reels are positioned at different locations behind the control line handling apparatus 100. In this manner, angular deflections on the control line(s) 103 can be minimized, thereby reducing loads, wear and the risk of damage to the control line(s) 103 or associated components.

Figure 11:
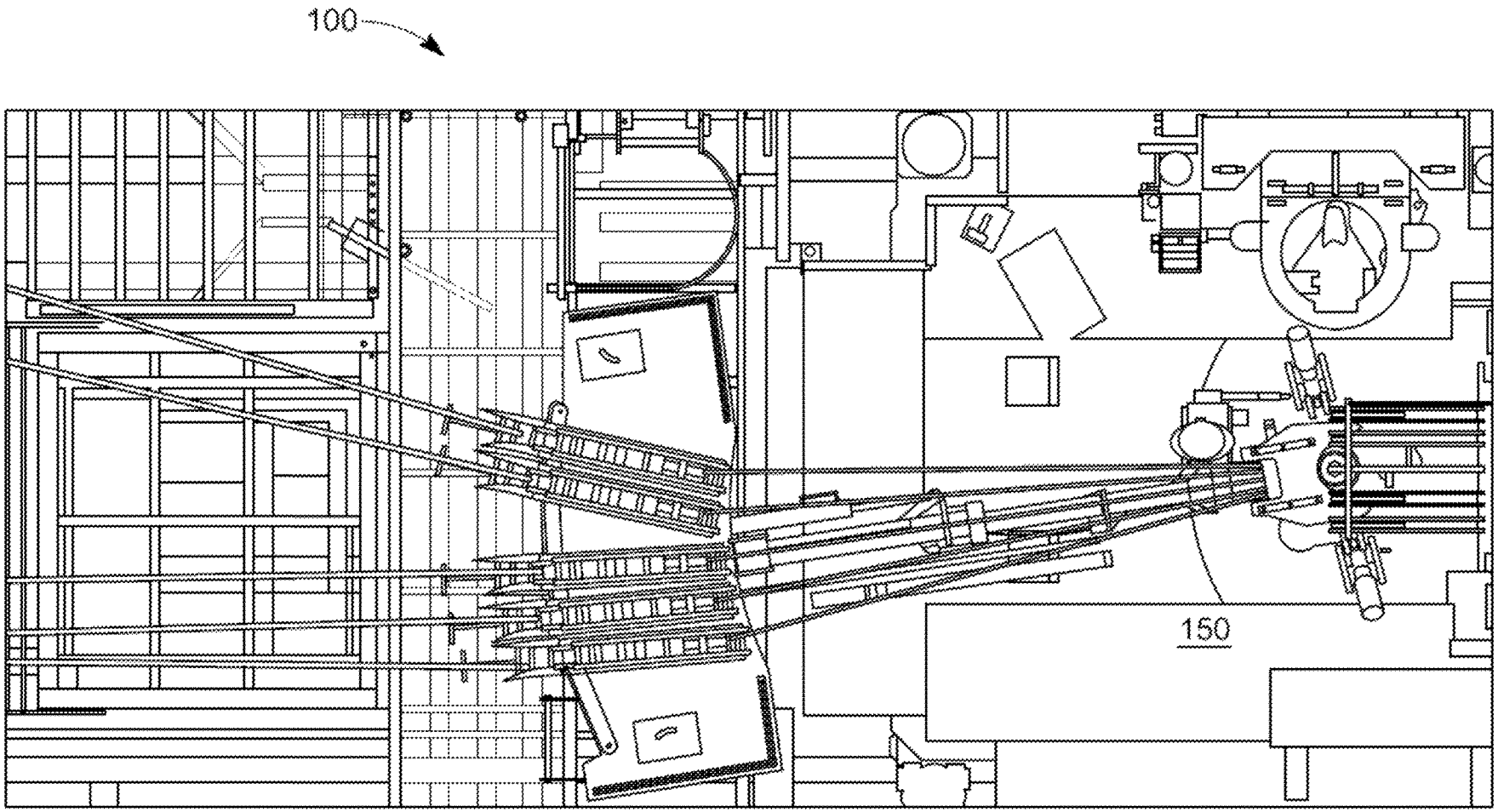

FIG. 10 shows a perspective view of parts of the apparatus 100 shown in FIG. 6A and FIG. 11 shows a top view of the apparatus 100 arranged adjacent a deck 150.

Shown in e.g. FIGS. 9 and 10, the actuator arm 106 may further comprise a parking position in which the actuator arm 106 is positioned vertically or substantially vertically. In the parking position, the actuator arm 106 can, for example, be arranged vertically and positioned along and adjacent the base 101 or the guide tower 120. In this manner, the apparatus 100 can be made compact, for example in a transport or movement configuration. In the parking position of the actuator arm 106, the guide head 102 can be positioned in a third position which is spaced from the guide head's first and second positions. This can further contribute to a compact arrangement in a non-operative position of the apparatus 100, such as a transport position.

Now referring to FIGS. 12-15, the apparatus 100 may further comprise a clamp head arm 131 having a clamp support head 130. Although the clamp head arm 131, clamp support head 130 and associated components are described in relation to FIGS. 12-15, these are applicable with all examples or embodiments described herein.

Figure 22:
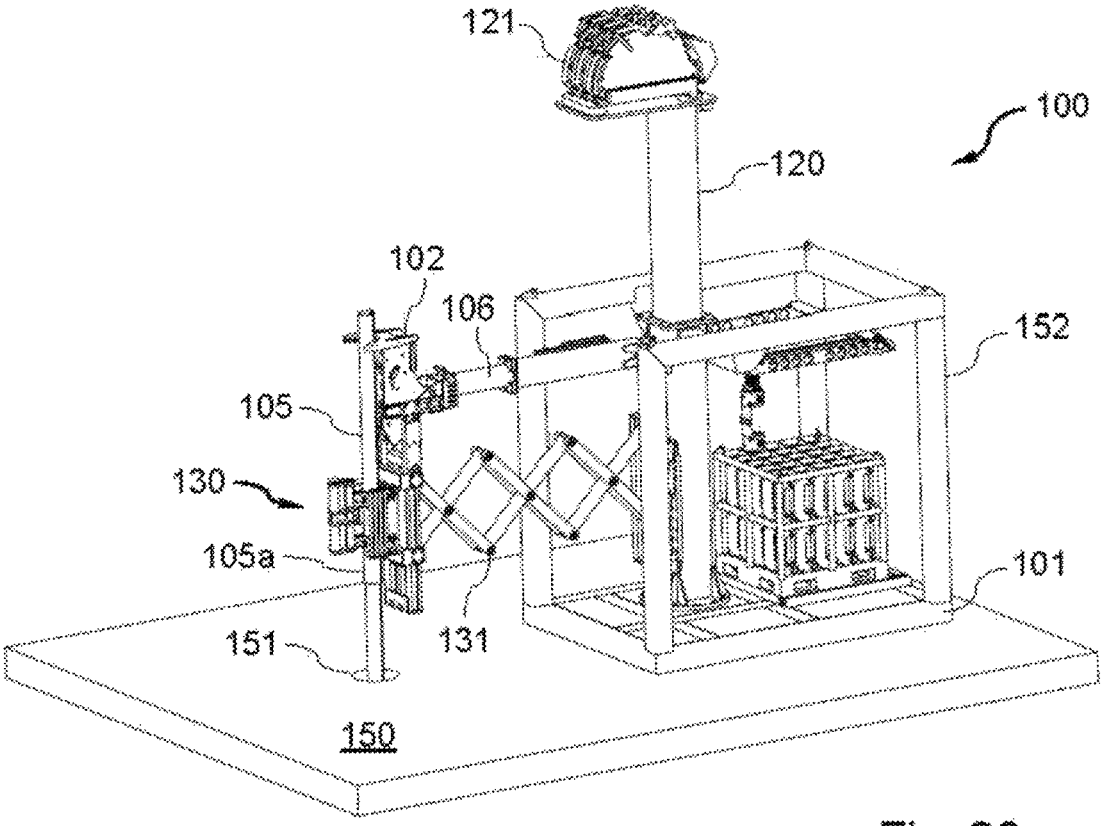

The clamp head arm 131 is movable between a first, retracted position in which the clamp support head 130 is spaced from the pipe string 105 and a second, advanced position in which the clamp support head 130 is positioned adjacent the pipe string 105 (not shown in FIGS. 12-15, but see e.g. FIG. 22 and the associated description below).

The clamp support head 130 in this example comprises a clamp holder 134, where the clamp holder 134 is arranged for holding a clamp 155 (not shown in FIGS. 12-15 but illustrated in FIGS. 26 and 27) and carrying the clamp 155 for engagement with the pipe string 105 in the second position. The clamp support head 130 may further comprise a clamp actuator 140 arranged for providing a closing force on the clamp in the second position to close the clamp on the pipe string 105. The function of the clamp holder 134 and clamp actuator 140 will be described in further detail below.

The clamp actuator arm 131 is movable independently of the actuator arm 106 over at least part of the distance between the first and second positions. The clamp actuator 131 may be independently movable over the full distance between the first and second positions, i.e. movable fully independently from the actuator arm 106. Alternatively, the clamp head arm 131 is operable to move independently of the actuator arm 106 over a part of the distance between the first and second positions, and configured to move in unison with the guide head 102 over another part of the distance between the first and second positions. For this purpose, the clamp actuator arm 131 and the actuator arm 106 can be equipped with controllers, for example electronic and/or hydraulic controls, in order to control the position and movement of each arm in relation to each other.

Alternatively, or additionally, the apparatus 100 may comprise a connector 132 having a first connector part 132*a* arranged on the clamp support head 130 and a second connector part 132*b* arranged on the guide head 102. The first and second parts 132*a,b* are selectively connectable such as to mechanically connect the clamp support head 130 to the guide head 102. In this manner, the clamp support head 130 can be mechanically locked to the guide head 102, whereby movement in unison of the two components can be secured, and the relative position between the two is also ensured. This can provide advantages in the positioning of the clamp support head 130 and guide head 102 in relation to the pipe string 105.

Figure 12:
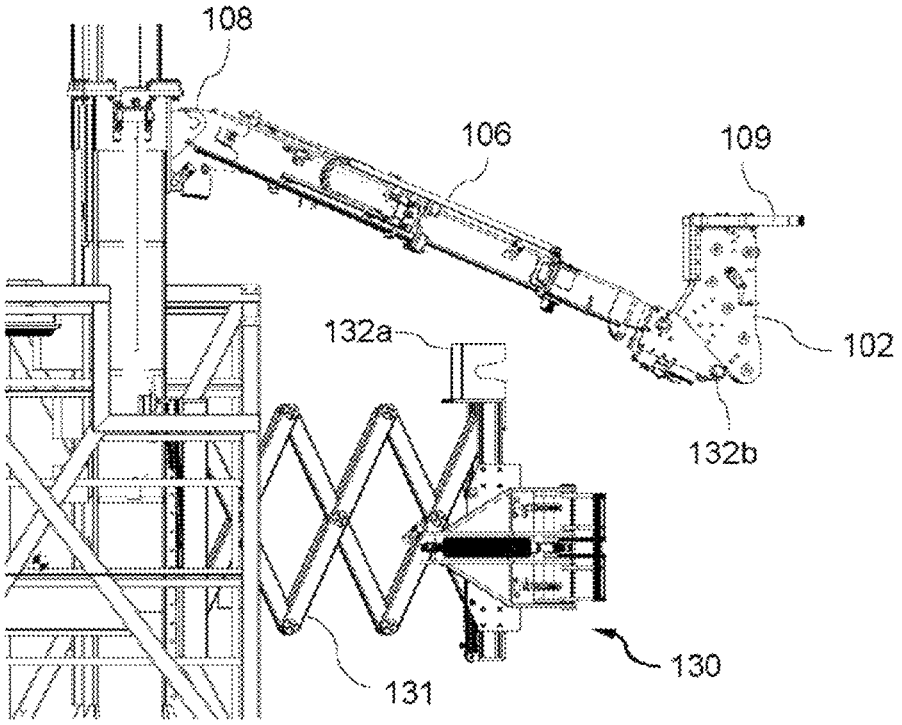
FIGS. 12-15 illustrate an example of a control line handling apparatus comprising a clamp head arm having a clamp support head.
Figure 13:
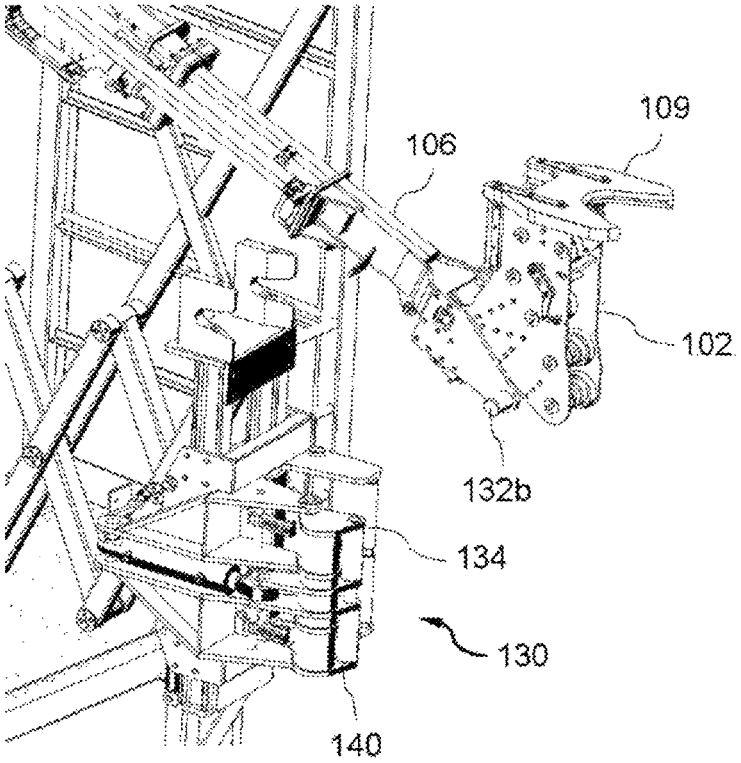
Figure 14:
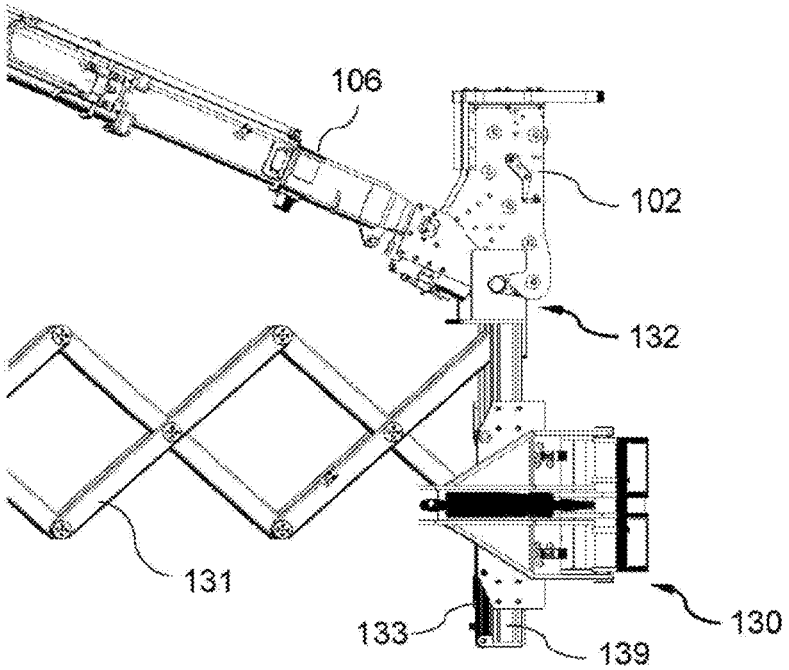
Figure 15A:
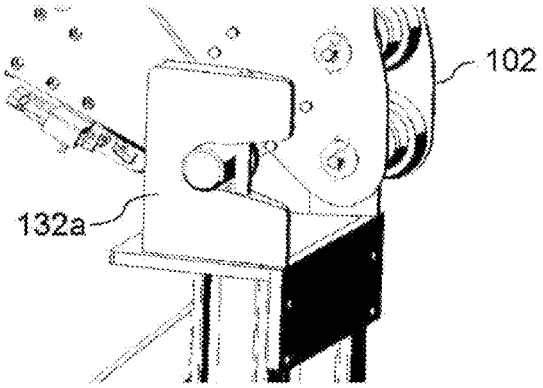
Figure 15:
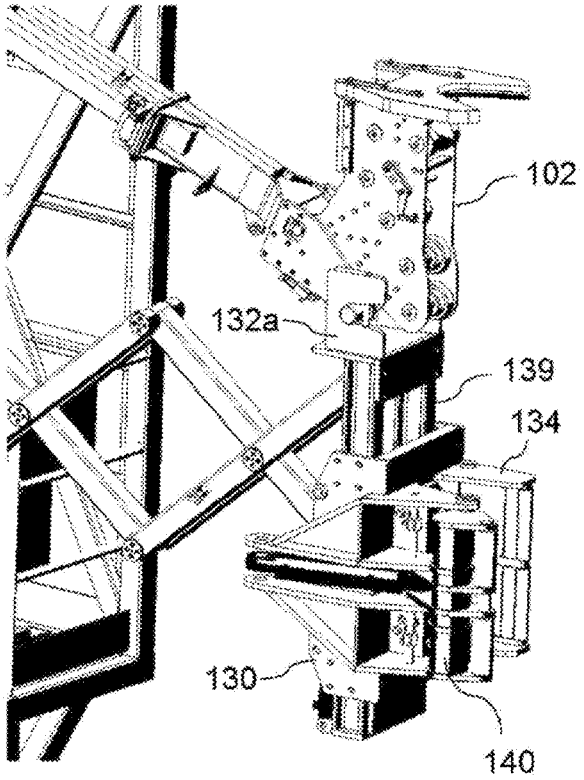

FIGS. 12 and 13 illustrate a first part of the movement of the clamp actuator arm 131 towards the advanced position. In this first part of the movement, the clamp actuator arm 131 is moved independently of the actuator arm 106 and the guide head 102. Shown in FIGS. 14, 15A and 15, between the first and second positions, the first and second connector parts 132*a,b* are brought into engagement such as to mechanically lock the guide head 102 and the clamp support head 130 together. The guide head 102 and the clamp support head 130 can thereafter be moved in unison towards the pipe string 105 and towards the advanced position.

The connector 132 can for example be a pin-and-slot arrangement as illustrated, wherein a pin arranged on one part is received and locked in a slot arranged on the other part. Various other mechanical connector principles would, however, be equally suitable for this purpose.

When connected, movement of the guide head 102 and the clamp support head 130 can be effected by an actuator on the actuator arm 106, by an actuator operating on the clamp actuator arm 131, or by both such actuators in unison. These actuators may, for example, be hydraulic cylinders. Advantageously, one of the actuators may be put in an idle state or a low-powered, constant tension state when connected, so that only one actuator is operative and the other simply follows the motion.

The clamp head arm 131 in the examples shown here comprises a pantograph or scissor mechanism for horizontal movement of the clamp head arm 131 between the first and second positions. Such mechanism can be advantageous for producing linear motion, as the mechanism can be made very compact in the retracted position. Alternatively, another mechanism such as a pivotable and/or telescopic arm similar to that illustrated in relation to actuator arm 106 may be used for the clamp head arm 131. Another alternative can include a linearly movable arm mechanism supported on tracks on the deck 150.

The clamp head arm 131 can be arranged to be movable partly or fully in a horizontal direction. In the examples shown, the clamp head arm 131 is movable only in a horizontal direction, between the first and second positions. This obviates the need for an actuator and motion mechanism to move the clamp head arm 131 vertically.

The clamp support head 130 may be movable vertically in relation to the clamp head arm 131. This can, for example, be done by means of an actuator 133 (see FIG. 14) operable to move the clamp support head 130 vertically in relation to the clamp head arm 131. The actuator can, for example, be a hydraulic cylinder, a threaded rod arrangement, or any other suitable actuator. Preferably, the actuator can be a linear actuator moving the clamp support head 130 vertically. The clamp support head 130 may be arranged on the clamp head arm 131 on rails, rods, or the like, along which the clamp support head 130 can move, illustrated in FIGS. 14 and 15 with rails 139. Such vertical movement can be beneficial for allowing the clamp support head 130 to be correctly positioned in relation to the pipe string 105, for example in relation to a tool joint on the pipe string 105, as also described further below.

Some further aspects and an operational sequence of a control line handling apparatus 100 will now be described with reference to FIGS. 16-25. The sequence shown in FIGS. 16-25 is shown without the control line(s) 103, however it will be understood that control line(s) 103 are foreseen similarly as e.g. in FIGS. 1-2 above.

Figure 16:
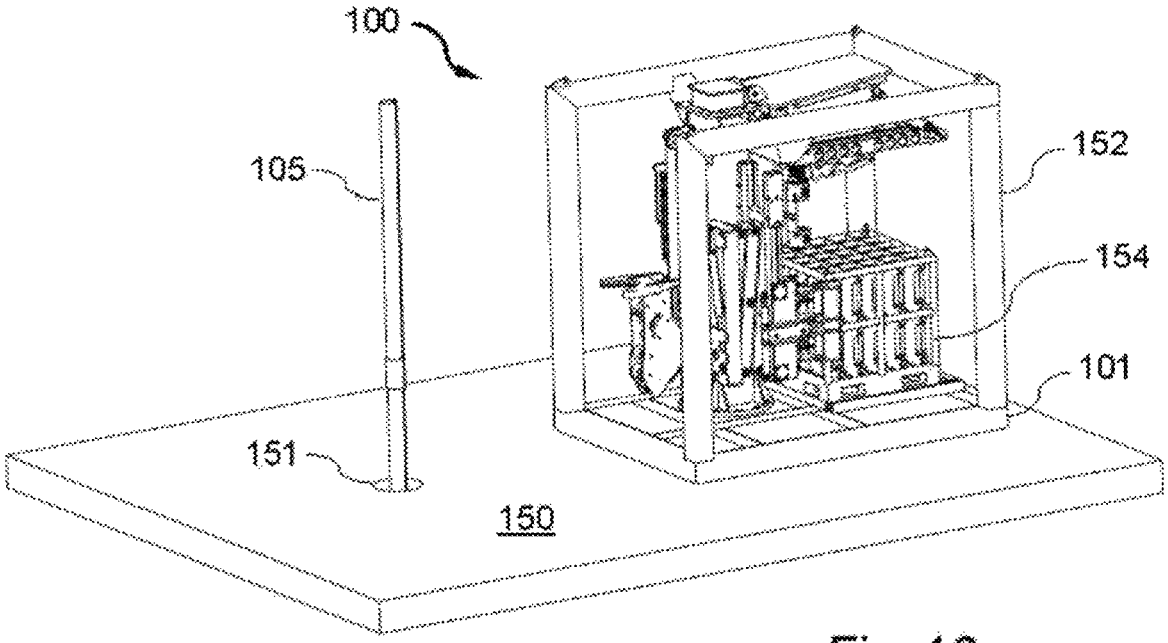
FIGS. 16-25 illustrate an example of a control line handling apparatus and an operational sequence thereof.

Shown in FIG. 16, the base 101 is positioning on a deck 150 adjacent a well opening 151. The control line handling apparatus 100 can be made modular and movable for this purpose, such that the base 101 is removably positioned on the deck 150. For this purpose, the base 101 may comprise a frame 152 or enclosure 153 (see FIG. 6A) into which the clamp head arm 131, actuator arm 106 and/or the guide tower 120 is at least partly retractable. As will be shown in FIG. 17*ff*, in this example the apparatus 100 comprises all these components, however optionally the apparatus 100 may comprise only some of these, such as only a guide tower 120 and an actuator arm 106 (cf. also FIGS. 1, 2 and 6A). In the retracted state, where these components are retracted into the frame 152 or enclosure 153, a transport configuration of the control line handling apparatus 100 is obtained such as to allow simplified movement of the apparatus 100 between positions (e.g., different wells) at an installation, or movement between installations or sites.

Figure 17:
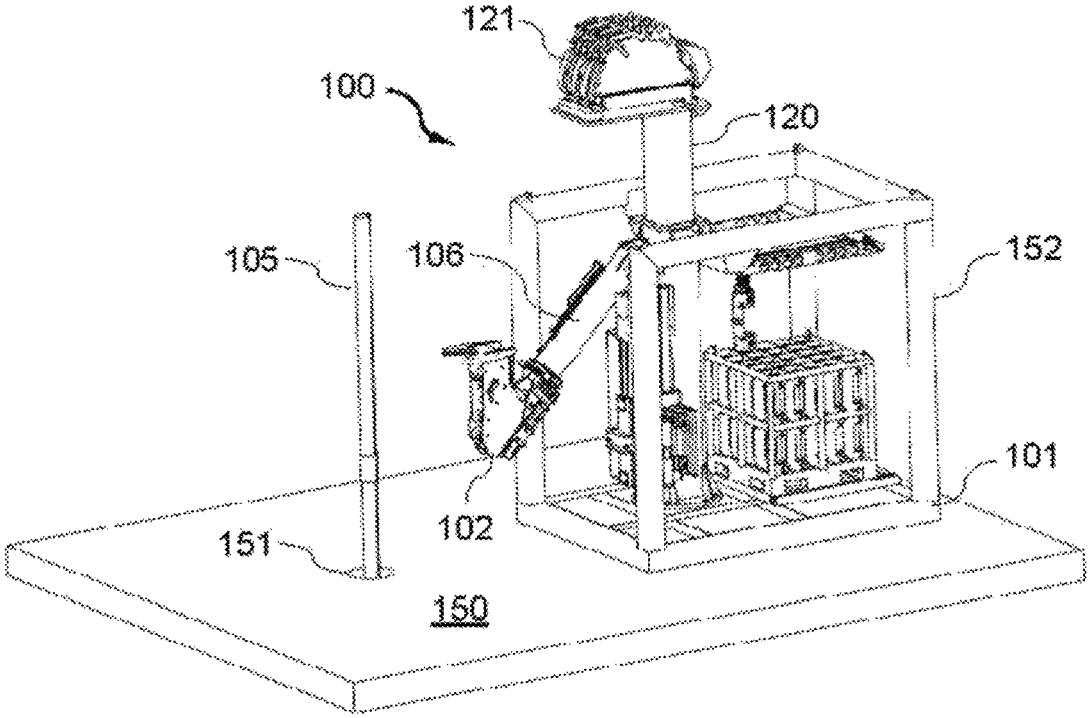

Shown in FIG. 17, the base 101 is positioned adjacent a well opening 151 on a deck 150. A guide tower 120 can be extended upwardly, having guide members 121 (e.g., sheaves) arranged thereon, similarly as described above. Further, an actuator arm 106 can be extended from a parking position to an extended, operative position. Control line(s) 103 (not shown here) may at this stage be arranged on the guide members 121 and guide head 102.

Figure 18:
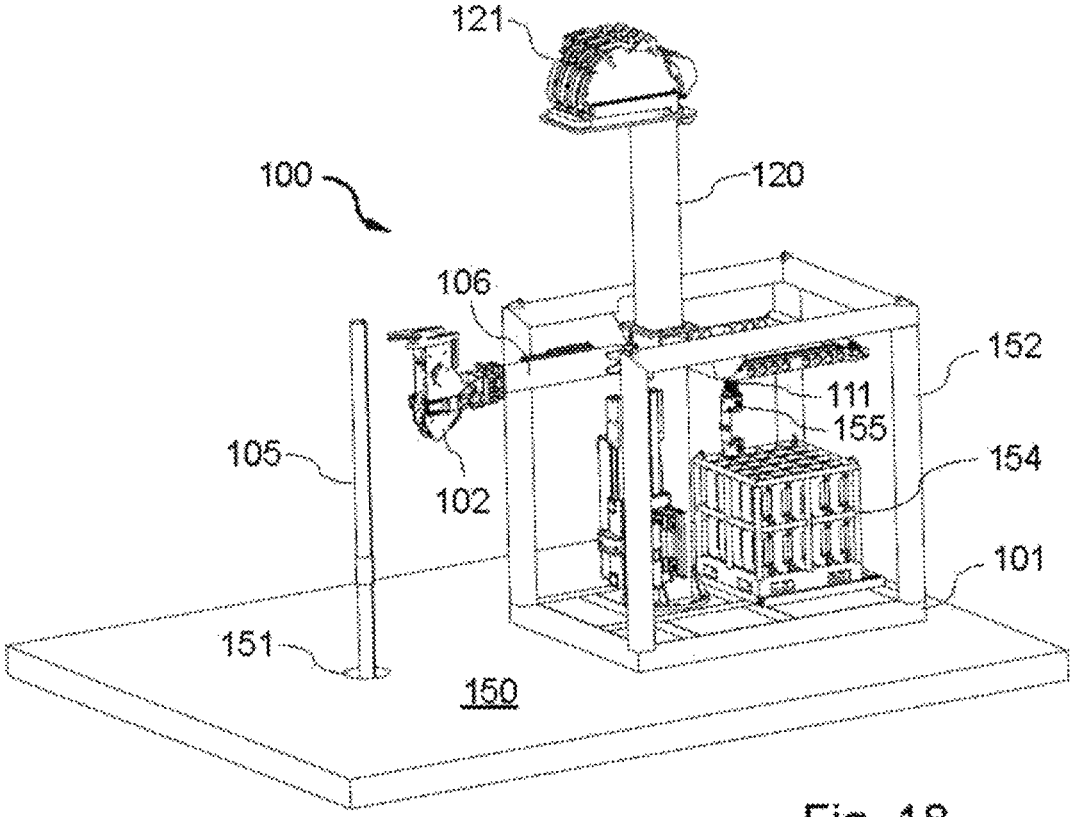

The operative position of the actuator arm 106 may, as shown in FIG. 18, be substantially horizontal or horizontal. In this horizontal or substantially horizontal position, the actuator arm 106 may move the guide head 102 between its advanced and retracted positions. Advantageously, this can require only a telescoping motion of the actuator arm 106 for this purpose. Alternatively, the actuator arm 106 may be arranged with an angle to the horizontal when in the operative position, such as for example the examples in FIGS. 1, 2 and 6A.

Figure 19:
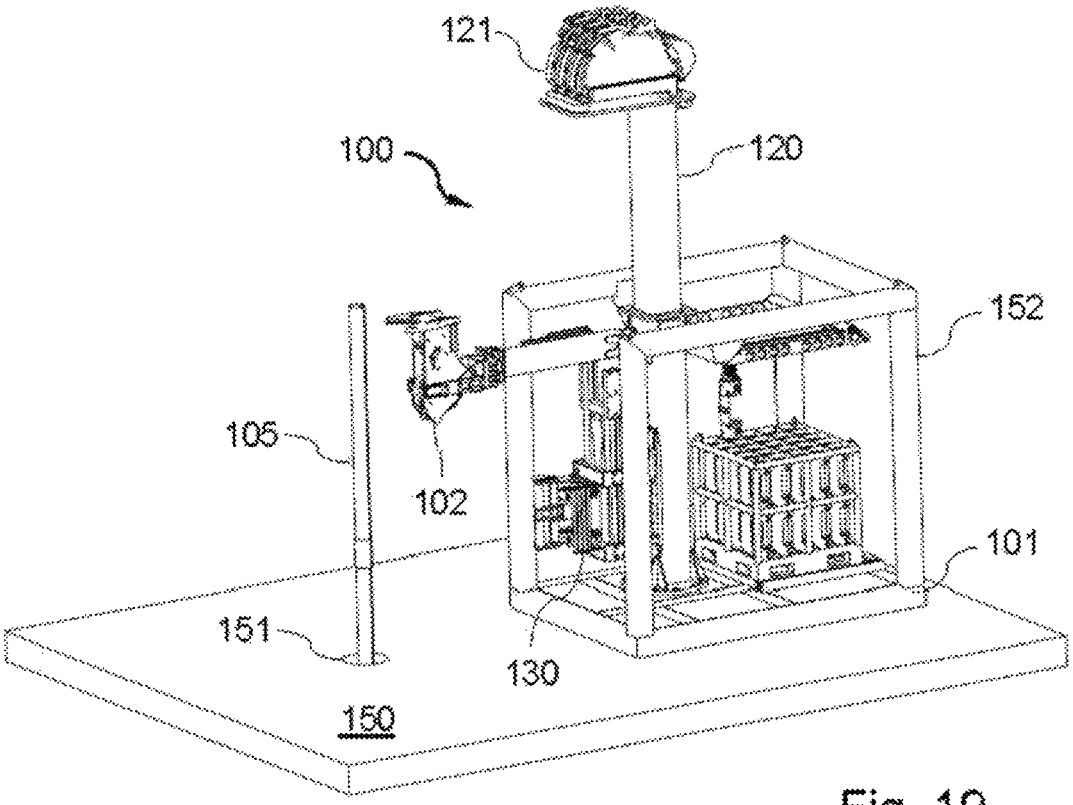
Figure 20:
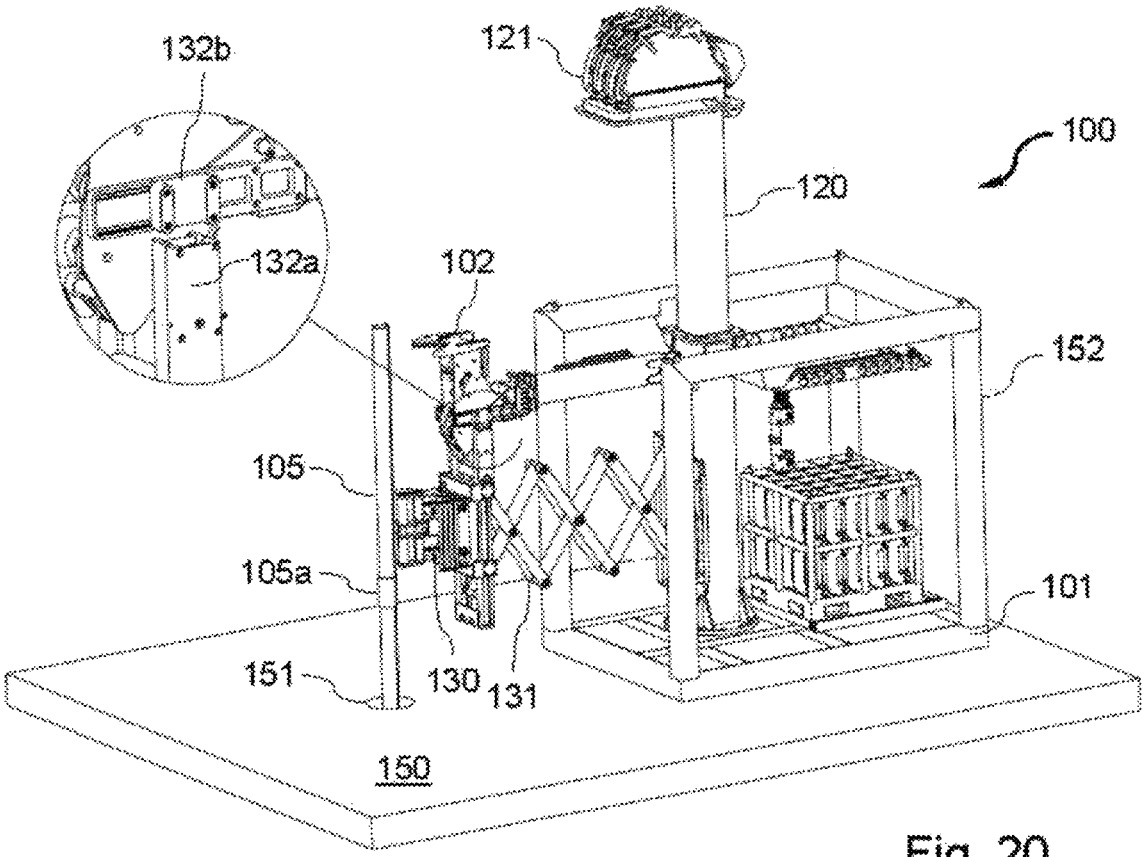

Shown in FIGS. 19 and 20, a clamp head arm 131 with a clamp head 130 can be extended from the base 101. The clamp head arm 131 with a clamp head 130 are generally similar to those described above in relation to FIGS. 12-15. The clamp head 130 preferably carries a clamp 155 (see FIGS. 26 and 27) when extended from the base 101, however optionally a clamp 155 may be positioned in the clamp head 130 prior to the clamp head 130 engaging the pipe string 105, for example by a human operator on the deck 150.

Figure 21:
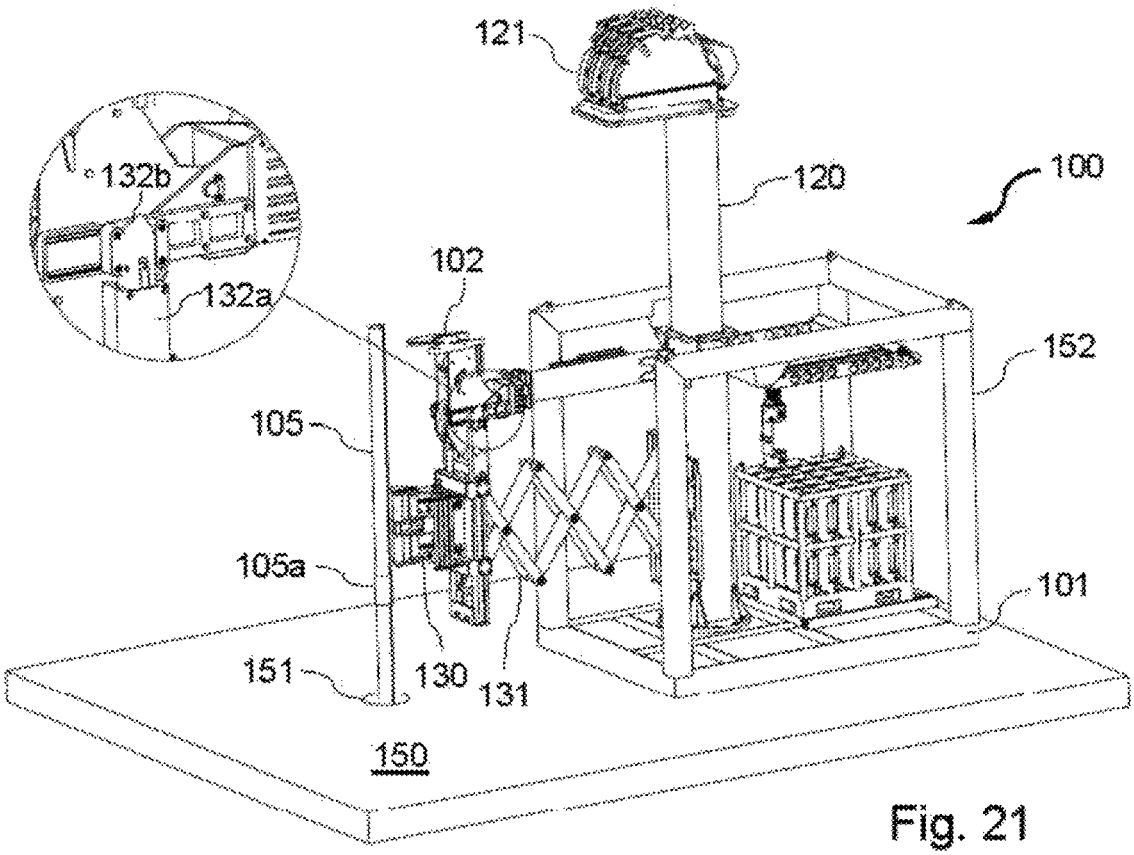

In FIGS. 20 and 21, a different alternative for the connector 132 is however shown, wherein an extendible and retractable pin is used for engaging and releasing the coupling between the guide head 102 and the clamp head 130. (See the encircled parts of FIGS. 20 and 21.)

With the guide head 102 and the clamp head 130 mechanically connected (FIG. 21), these can be advanced farther towards the pipe string 105 in unison. Positioning of the guide head 102 and the clamp head 130 in relation to the pipe string 105 may be assisted by means of a receptacle 109 or equivalent on the guide head 102 or the clamp head 130 (see e.g. FIG. 5 above). In the advanced position (FIG. 22), the pipe string 105 is arranged in the clamp head 130.

Figure 23:
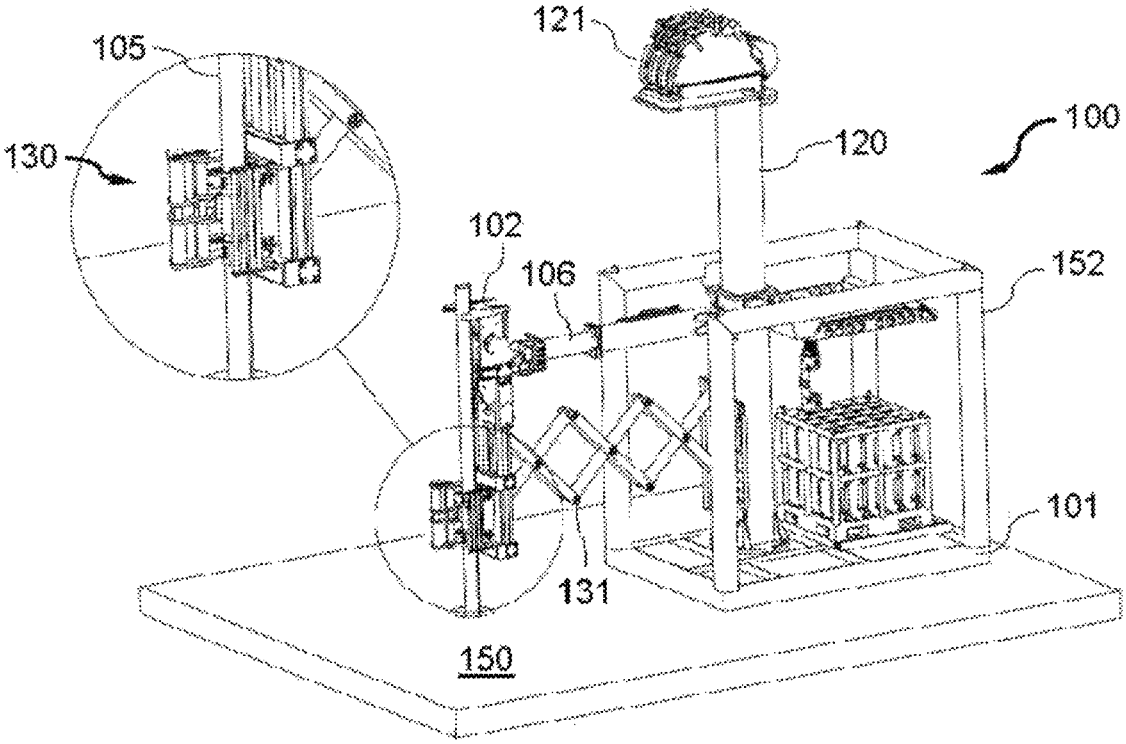

The vertical position of the clamp head 130 can, optionally, be vertically adjusted at this stage, as described above. (See FIGS. 14 and 15 and the associated description.) Particularly, the clamp head 130 may be vertically adjusted such as to position the clamp 155 correctly in relation to a tool joint 105*a* or equivalent on the pipe string 105 (see also FIGS. 20 and 21). A tool joint 105*a* is typically a connection between two sections of pipe and forms a protrusion on the outer surface of the pipe string 105. It may be desirable to position the clamp 155 such as to span the tool joint 105*a*, i.e. to clamp the control line(s) 103 at positions immediately above and below the tool joint 105*a*. For this purpose, a vertical adjustment of the clamp head 130 can be beneficial, to reduce the requirements for an accurate positioning of the pipe string 105 in relation to the apparatus 100 when the pipe string 105 is hung off in the well opening 151. FIG. 22 illustrates the clamp head 130 prior to such a vertical adjustment, while FIG. 23 illustrates the clamp head 130 after vertical adjustment to position the clamp head 130 adjacent the tool joint 105*a*. (Highlighted in the encircled part of FIG. 23.)

Figure 24:
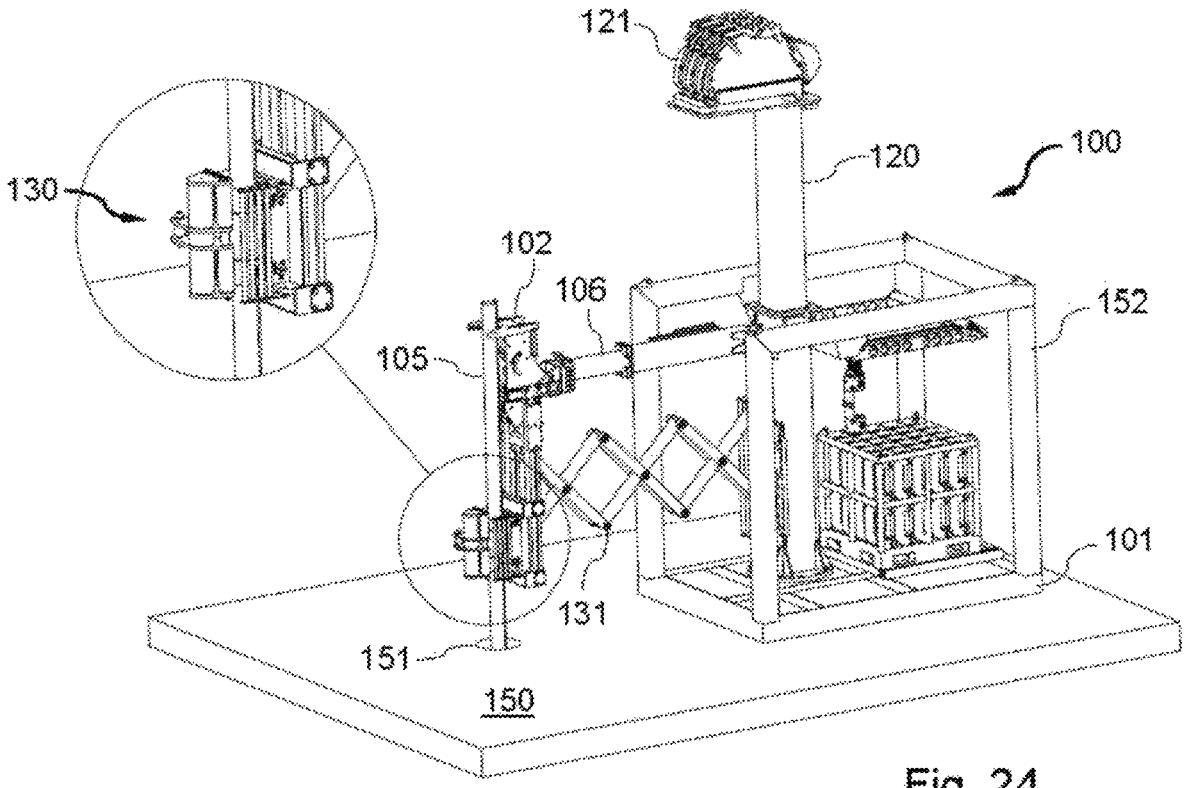
Figure 25:
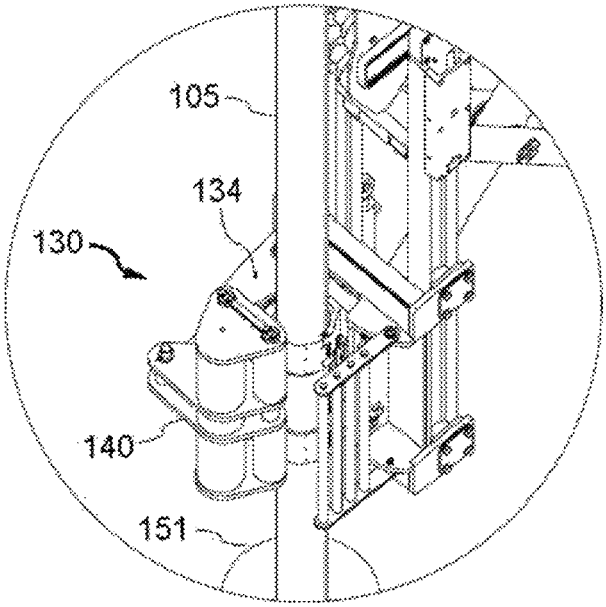

When in the correct position, the clamp actuator 140 may be activated to close the clamp 155 on the pipe string 105 and thereby fix the control line(s) 103, which are positioned inside the clamp 155 and between the clamp 155 and the pipe string 105, to the pipe string 105. This stage is illustrated in FIG. 24. FIG. 25 illustrates further details of the clamp head 130 in this closing operation, where the clamp actuator 140 is operated to push the clamp 155 closed. The clamp 155 can be seen arranged about the pipe string 105 in the clamp head 130 in FIG. 25. (See also FIGS. 26 and 27.) The clamp actuator 140 may for this purpose, for example, have a hinged member which is driven by a linear actuator such as a hydraulic cylinder, and is operable to exert a force onto the clamp 155.

Figure 26:
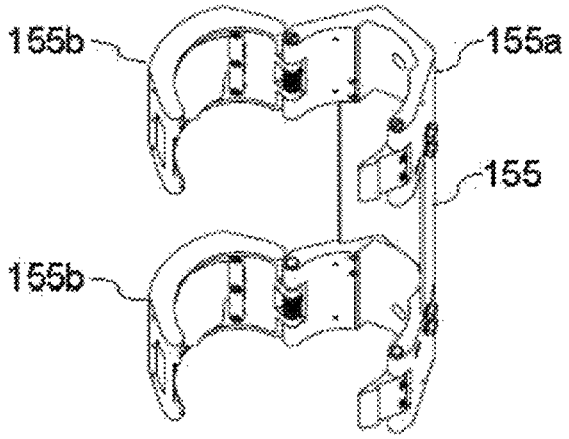
FIGS. 26 and 27 illustrate a clamp suitable for use with the apparatus.
Figure 27:
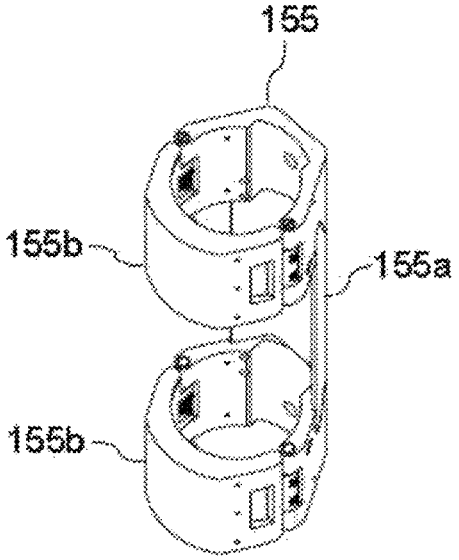

FIGS. 26 and 27 illustrate a clamp 155 suitable for use with the apparatus 100. The clamp 155 comprises a first part 155*a*, which may be held fixed by the clamp head 130 when moving the clamp head 130 towards the pipe string 105 and when bringing the clamp head 130 into engagement with the pipe string 105. The first part 155*a* may, for example, be held magnetically or via a gripper by the clamp head 130. The clamp 155 further comprises at least one second part 155*b* which is movable relative to the first part 155*a*, for example hinged on the first part 155*a*. In this example, the clamp 155 comprises two second parts 155*b*. For closing the clamp 155 on the pipe string 105, the clamp actuator 140 is provided with an engagement surface which pushes the second part(s) 155*b* closed, as illustrated in FIG. 27. The clamp 155 may have a lock mechanism to hold the clamp 155 closed after activation of the clamp actuator 140, for example in the form of a click-on connector or a ratchet lock mechanism. Other suitable locking mechanisms for the clamp 155 may be a one-way friction-based lock, a spring-based lock. The clamp 155 may, alternatively, have a manual connector, such as a bolt or screw connector, and wherein the clamp head 130 comprises appropriate tools to engage the connector and fix/make up the connection.

Figure 28:
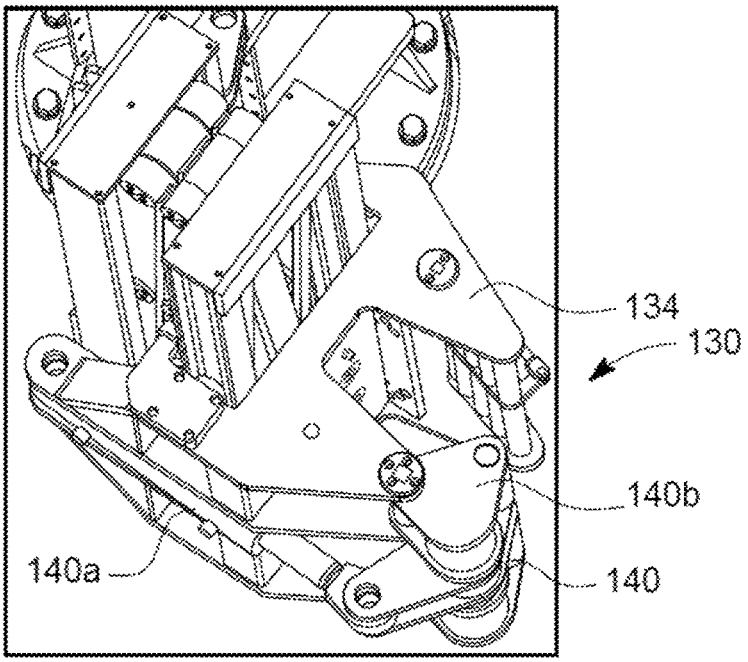
FIG. 28 illustrates details of a clamp head according to an example.

FIG. 28 illustrates the clamp head 130 with the clamp actuator 140, driven by a linear actuator 140*a*. An inward-facing surface of the clamp actuator 140 engages the second part(s) 155*b* in order to close the clamp 155.

The clamp 155 may be held in the clamp holder 134 by the clamp holder 134 engaging the first part 155*a*, for example by a gripper or magnetically. As illustrated in FIGS. 26 and 27, the first part 155*a* may be connected to the second part(s) 155*b* via a hinge on the clamp 155. When the clamp 155 is held in the clamp holder 134, the second part(s) 155*b* can be supported against the clamp actuator 140 when in the "clamp open" position or state (as shown in FIG. 26), and the clamp actuator 140 can be operable to, via a movable closing member 140*b* (see FIG. 28), move the at least second part 155*b* to bring the clamp 155 to a closed position or state (i.e. the one illustrated in FIG. 27).

Advantageously, the second part(s) 155*b* can be made pivotable relative to the first part 155*a* about a vertical axis, via the hinged connection. In this manner, the movable closing member can push the clamp 155 closed by a horizontal force applied on the second part(s) 155*b*. The closing member 140*b* can be arranged pivotable about a vertical axis for this purpose, as illustrated in FIG. 28, and thereby move pivotably along with the second part(s) 155*b* during the closing motion.

The clamp 155 may have a spring (or another type of biasing member) urging the first part 155*a* and the at least one second part(s) 155*b* towards the clamp open position. Such as spring may, for example, be arranged in the hinge between the parts, as indicated in FIG. 26. In this manner, the second part(s) 155*b* may be held against the closing member 140*b* prior to activation, e.g. in order that the clamp support head 130 can reliably move the clamp 155 in the correct position in relation to the pipe string 105 with the clamp 155 in the open position or state (FIG. 26). The closing member 140*b* may then be activated to close the clamp 155 on the pipe string 105, pushing the second part(s) 155*b* closed against the spring force, and lock the clamp 155 closed as described above.

Referring now back to FIG. 16, the base 101 may further comprise a clamp magazine 154. The clamp support head 130 can be configured for receiving a clamp 155 from the clamp magazine 154 when in the first, retracted position. The first, retracted position of the clamp support head 130 may for this purposes be inside the frame 152 or enclosure 153, such that the clamp support head 130 is retracted to a position within the frame 152 or enclosure 153 to receive a new clamp 155 during successive clamp installation operations along the pipe string 105 as the pipe string 105 is lowered into the well opening 151. In this manner, placing a new clamp 155 onto the clamp head 130 can be done in a controlled manner in a secure location. This may reduce the need for personnel in high-risk areas, such as on the deck 150 around the well opening 151. The positioning of a new clamp 155 onto the clamp head 130 can be done manually, for example by a human operator, or automatically, for example by a robotic arm. A robotic arm for this purpose is illustrated in FIG. 18, where the apparatus 100 comprises a clamp transport arm 111 operable to pick up a clamp 155 from the magazine 154 and position the clamp 155 onto or adjacent the clamp support head 130. This may be done while the clamp support head 130 is in a retracted position, such as that illustrated in FIG. 18 or FIG. 19. The clamp transport arm 111 can, as illustrated, be operable to reach into the magazine 111 from above to pick up a clamp 155, and then move the clamp 155 to the clamp support head 130. The clamp transport arm 111 may, for example, be arranged on rails or with a hydraulic positioning arrangement for this purpose, such that the clamp transport arm 111 is movable between individual slots of the magazine 154 and an advanced position in which the clamp 155 can be delivered to the clamp support head 130. This configuration further reduces health and safety risks, in that the need for human personnel in operating areas is reduced. The clamp magazine 154 may, optionally, be arranged such as to be replaceable, i.e. wherein a new clamp magazine 154 can be provided during operation with additional clamps 155.

Figure 30:
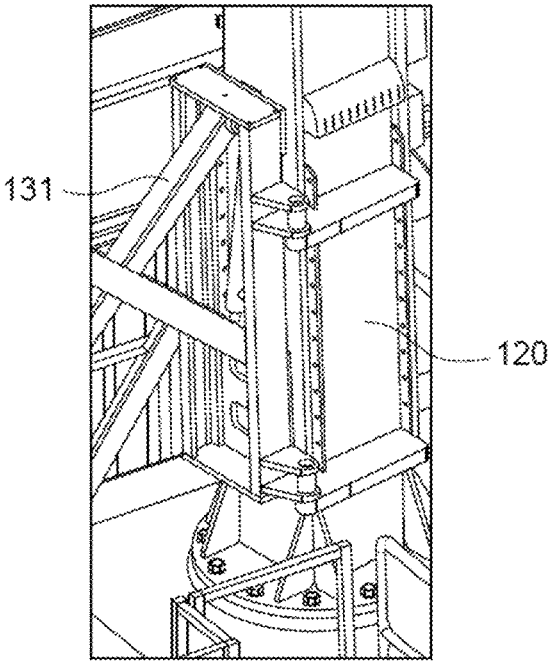
FIG. 30 illustrates a pivotable connection between a clamp head arm and a base according to an example.

Advantageously, in any of the examples or embodiments described herein, the clamp head arm 131 can be fixed to the guide tower 120. This is illustrated in FIG. 30. Alternatively, the clamp head arm 131 can be fixed to another part of the base 101.

Also illustrated in FIG. 30 is that the clamp head arm 131 can be pivotably fixed to the guide tower 120. (Optionally, the clamp head arm 131 can be pivotably fixed to another part of the base 101.) In this manner, the clamp head arm 131 can be made pivotable about a vertical axis when the clamp support head 130 is in the first, retracted position. This pivotable motion may be provided for while the clamp head arm 131 and the clamp head 130 are inside the frame 152 or enclosure 153. This allows the clamp head arm 131 to be moved (e.g., swung sideways) between a clamp pick-up position and an active position in which the clamp head arm 131 can be moved towards the second, advanced position. This arrangement can be advantageous to allow a new clamp 155 to be positioned on the clamp head 130 in a safe and reliable manner, in that the clamp head 130 can, for example, be swung sideways to a side or back area of the base 101, where a human operator or a robotic arm (e.g., a clamp transport arm 111 as described above) can be positioned for providing a new clamp 155 to the clamp head 130.

Figure 29:
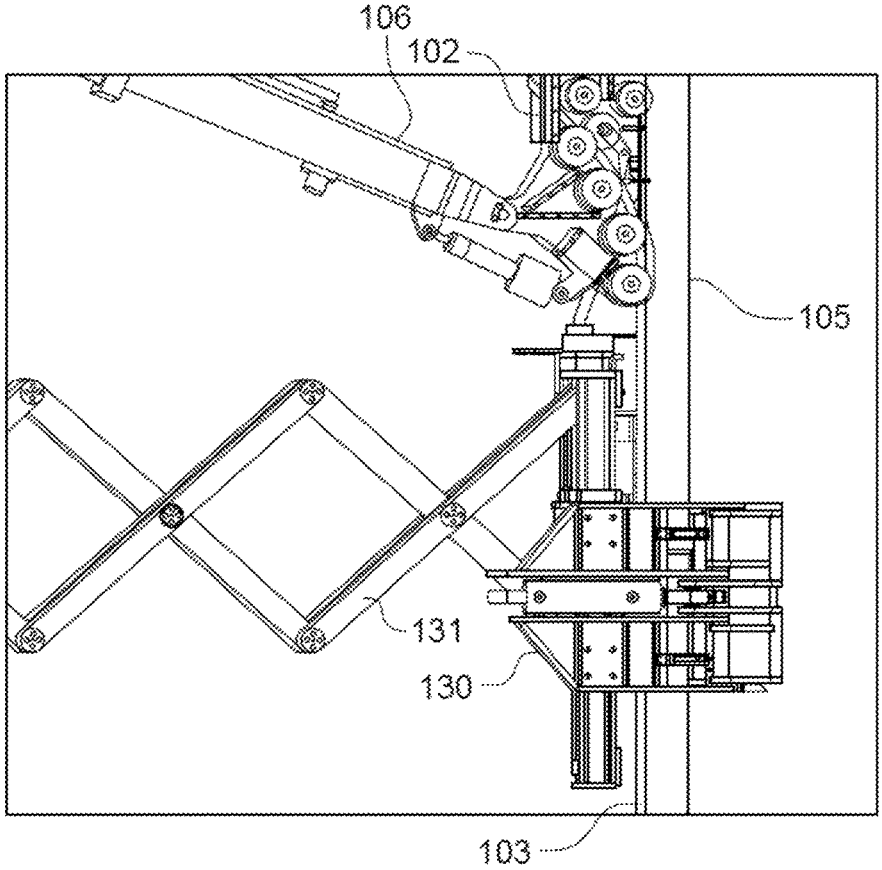
FIG. 29 illustrates a clamp head and guide head in one operational situation of the apparatus.

FIG. 29 illustrates an example of the guide head 102 and clamp head 130 when in engagement with the pipe string 105, and with control line(s) 103 held in position against the pipe string 105.

According to some examples or embodiments described herein, improved operational efficiency and reliability can be achieved when carrying out operations on control lines, while ensuring that the control lines are correctly positioned and installed on the pipe string. The apparatus may further be designed comply with health and safety requirements, for example if it is desirable to reduce the presence of human operators in critical areas.

Illustrated in FIGS. 31-34, in an aspect there is provided a clamp 155 for holding a control line 103 (or several control lines) on a pipe string 105. The pipe string 105 may, as in the examples described above, for example be a production tubing for positioning in a petroleum well. The clamp 155 comprises a first part 155*a* and at least one second part 155*b*. In the example shown, the clamp 155 has two vertically spaced second parts 155*b*.

Figure 31:
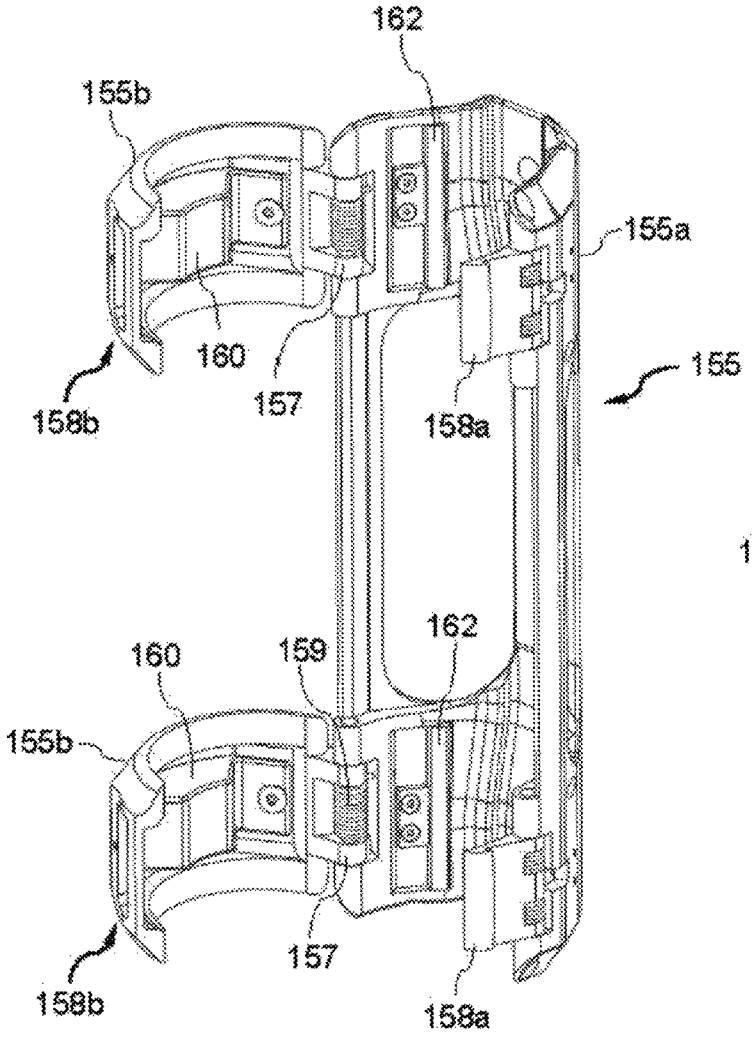
FIGS. 31-34 illustrate a clamp according to an example.
Figure 32:
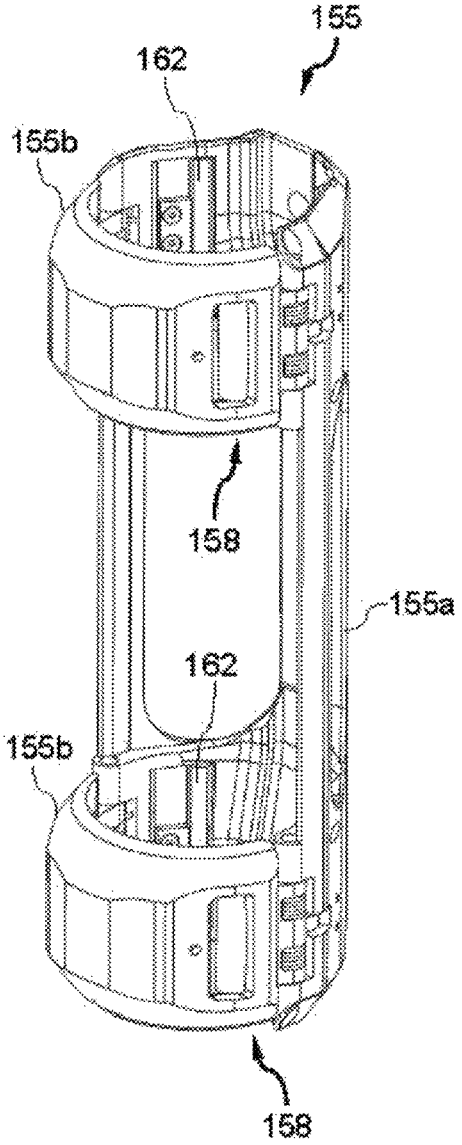
Figure 33:
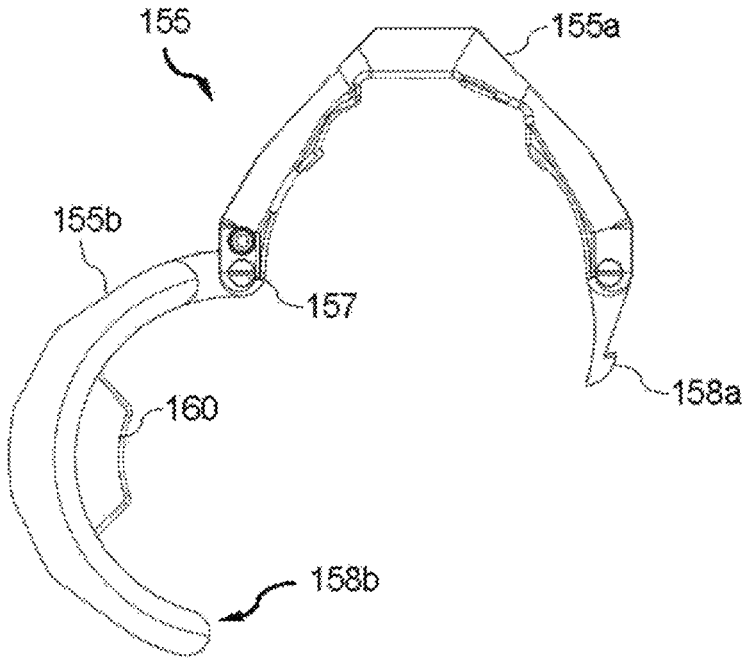
Figure 34:
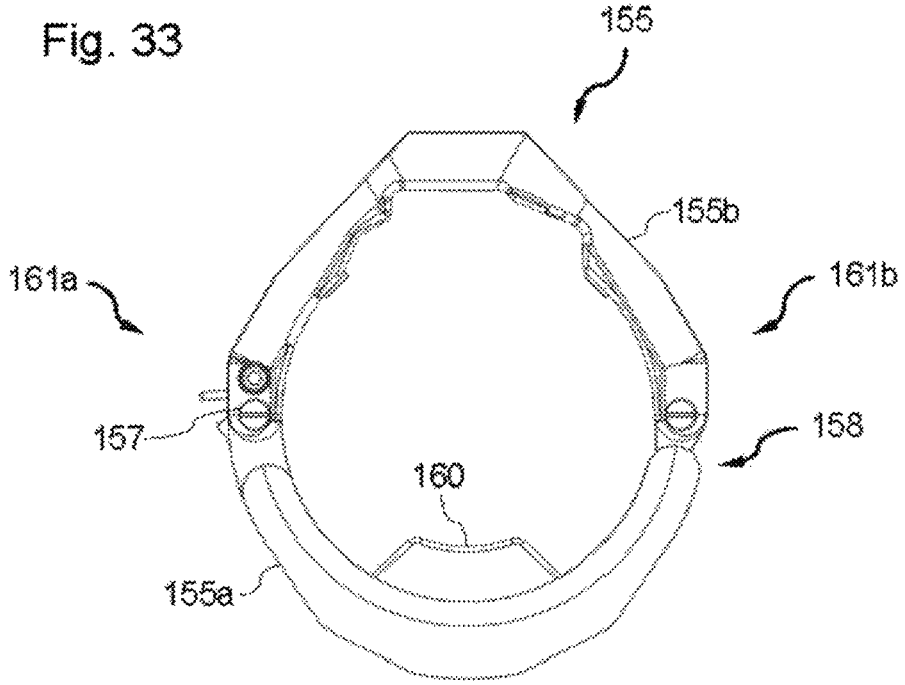

The second parts 155*b* in this example are connected to the first part 155*a* via a hinge 157. The hinge 157 provides a pivot functionality such that the at least one second part 155*b* is pivotable relative to the first part 155*a* about a vertical axis. A lock 158 is operable to lock the first part 155*a* to the second part 155*b*. The lock has first lock parts 158*a* arranged on the first part 155*a* of the clamp 155 and second lock parts 158*b* arranged at each second part 155*b*. FIG. 31 illustrates the clamp 155 in the open position, and FIG. 32 illustrates the closed position of the clamp. FIGS. 33 and 34 illustrate top views of the open and closed position of the clamp 155, respectively. When closing the clamp 155, as illustrated in FIG. 32, the lock parts 158*a-b* come into engagement and lock the second part(s) 155*b* to the first part 155*a*.

Advantageously, the hinge 157 is arranged at a first side 161*a* of the clamp 155 and the lock 158 is arranged on a second, radially opposite side 161*b* of the clamp 155.

In the example shown, the two vertically spaced second parts 155*b* are independently pivotable relative to the first part 155*a* about the same vertical axis.

The clamp 155 may further comprise a biasing member, for example a spring 159, urging the first part 155*a* and the at least one second part 155*b* towards a clamp open position (i.e., the position shown in FIGS. 31 and 33).

Each of the first and second parts 155*a-b* may be formed such as to make up substantially a half-circle in the horizontal plane, such that the first and second parts 155*a-b* in conjunction fully enclose the pipe string 105 when the clamp 155 is in the closed position.

The lock 158 may be one-way lock, i.e. a lock which engages and locks when the first and second lock parts 158*a-b* are brought into contact. This may be in the form of a click-on or snap-on connector as illustrated in FIGS. 31-34. Suitable locks include a ratchet-type lock, a spring-loaded latch, friction-based one-way locking system, an over-centre type lock, a buckle, or another type of one-way lock.

Alternatively to having a hinge between the first part 155*a* and the second part(s) 155*b*, the second part(s) 155*b* can be connectable to the first part 155*a* via one or more one-way lock(s). For example, the second part(s) 155*b* can be connectable to the first part 155*a* via two one-way locks arranged on radially opposite sides 161*a-b* (see FIG. 34) of the clamp 155. In this manner, the second part(s) 155*b* can be separate from the first part 155*a*. A one-way lock can be provided in place of the hinge 157 in such an example. The one-way locks may in such an example be similar to the lock 158 described above.

The clamp 155 may further comprise an elastic member 160 configured for engagement with the pipe string 105. In the illustrated example, the elastic member 160 is a compressible member arranged at an inwardly facing part of the clamp 155. The elastic member 160 can in this manner be arranged to provide a pre-tensioning force between the clamp 155 and the pipe string 105, such as to give a tighter connection between and reduce the risk of the clamp 155 or the control line(s) 103 moving in relation to the pipe string 105. Additionally, the elastic member 160 can assist in holding the lock 158 in the closed position by setting up a force urging the first and second lock parts 158*a-b* into tight engagement after a clamp locking force (e.g. from a clamp actuator 140 as described above) has been released.

The elastic member(s) 160 can be arranged on the second part(s) 155*b*, as illustrated in FIGS. 31-34. One elastic member 160 can be provided on each second part 155*b*, or only one second part 155*b* may be provided with the elastic member 160. In this example, the elastic member(s) 160 will not be in engagement with the pipe string 105 in the clamp open position (FIGS. 31 and 33). When closing the clamp 155, the elastic member(s) 160 will be pressed towards the pipe string 105 and compressed. As the lock(s) 158 engage(s), the compression force will exert a pre-tensioning force between the clamp 155 and the pipe string 105, assisting in holding the clamp 155 and control line(s) 103 correctly in place in relation to the pipe string 105.

Alternatively, the elastic member 160 can be arranged on the first part 155*a*, or elastic members 160 can be arranged both on the first part 155*a* and on the second part(s) 155*b*.

The elasticity of the elastic member(s) 160 is thus higher than that of the first and second parts 155*a-b*, which are typically made of a rigid material, such as a metal. The elastic member(s) 160 can, for example comprise or be made entirely of an elastomer. Advantageously, the elastic member(s) 160 may comprise or be made of rubber.

The elastic member(s) 160 can be arranged integrally with and fixed to the second part(s) 155*b*, as illustrated in FIGS. 31, 33 and 34. In this manner, the elastic member 160 can be fixed to the clamp 155 while handling the clamp 155, for example if handling the clamp 155 with a machine according to one of the examples or embodiments described above, or while handling the clamp 155 manually. The elastic member(s) 160 can, similarly, be arranged integrally with the first part(s) 155*a*, if applicable.

Optionally, the clamp 155 may comprise an anti-slip insert 162 (see FIGS. 31 and 32). The anti-slip insert 162 can be releasably fixed in the first part 155*a* or the second part 155*b*, for example by means of a screw or bolt and a bracket or similar. The anti-slip insert 162 can be used to provide increased friction between the clamp 155 and the pipe string 105.

For this purpose, the anti-slip insert 162 can be arranged with a surface having higher friction than the rest of the clamp 155. The anti-slip insert 162 may, for example, be similar to dies used in oilfield drilling equipment such as pipe slips, power tongs, or similar machinery handling pipes.

FIGS. 35-39 illustrate other examples of a clamp 155. The clamp 155 is shown arranged on a pipe string 105, across a tool joint 105*a* of the pipe string 105. The second parts 155*b* are arranged to engage the pipe string 105 on longitudinally opposite sides of a tool joint 105*a* on the pipe string 105.

FIGS. 35-38 further illustrate a plurality of control lines 103 held in place by the clamp 155.

Figure 39:
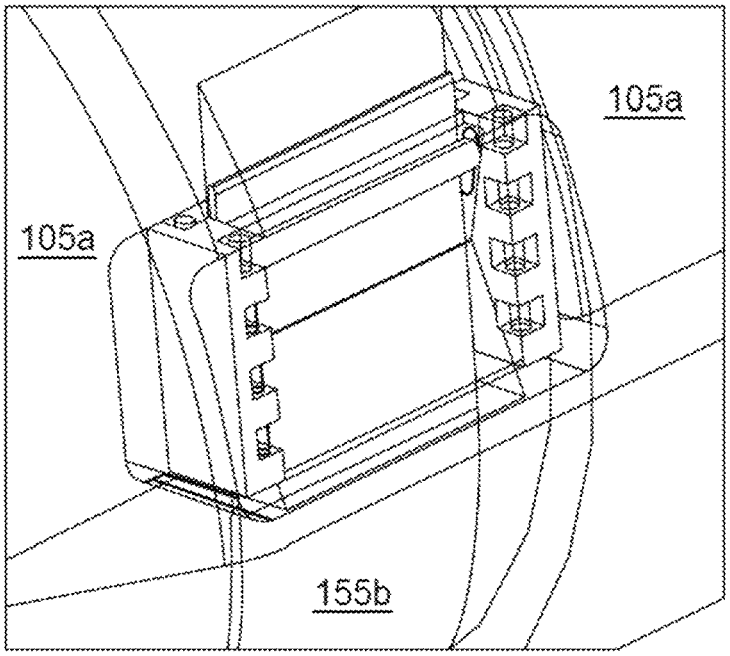

FIGS. 35-39 illustrate various alternative locks 158 of the snap-on, click-on and friction (FIG. 38) types. FIG. 39 illustrates details of the friction lock illustrated in FIG. 38, wherein the second part 155*b* is engaged by a wedge pin fixed in a one-way friction lock mechanism arranged on the first part 155*a*.

Figure 35:
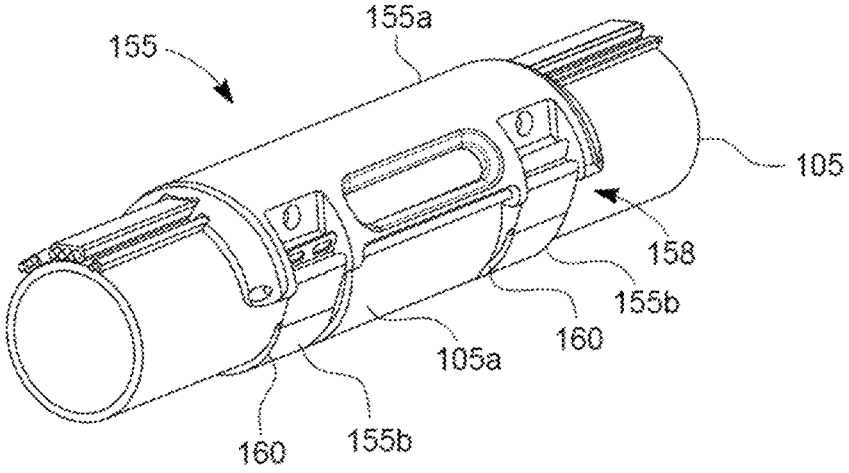
FIGS. 35-39 illustrate various clamps according to other examples.
Figure 36:
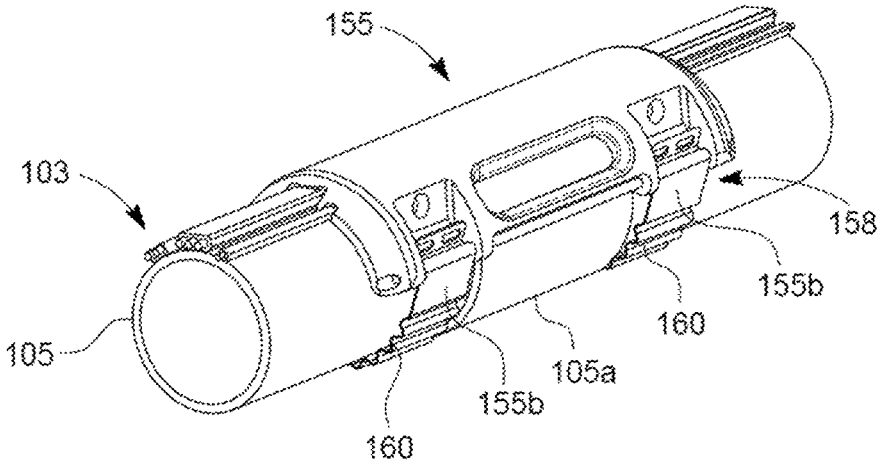
Figure 37:
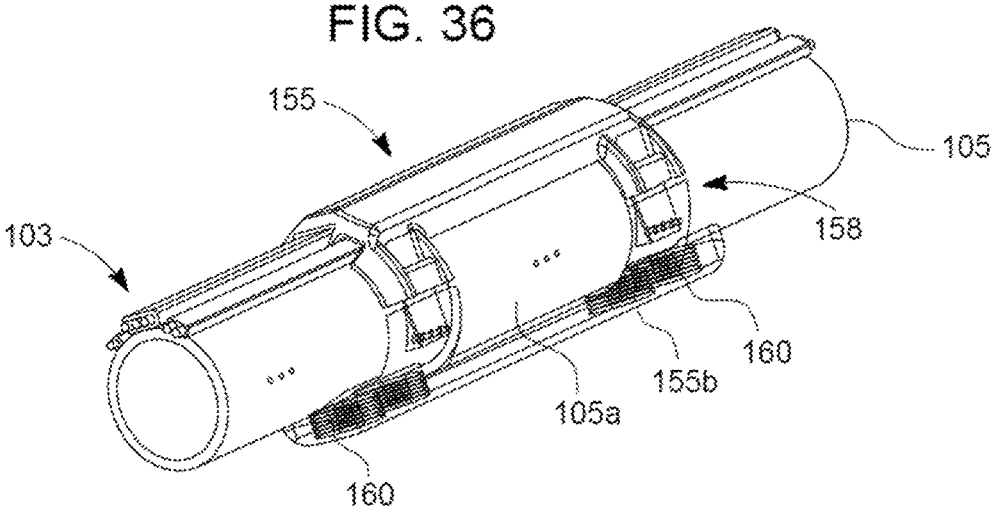
Figure 38:
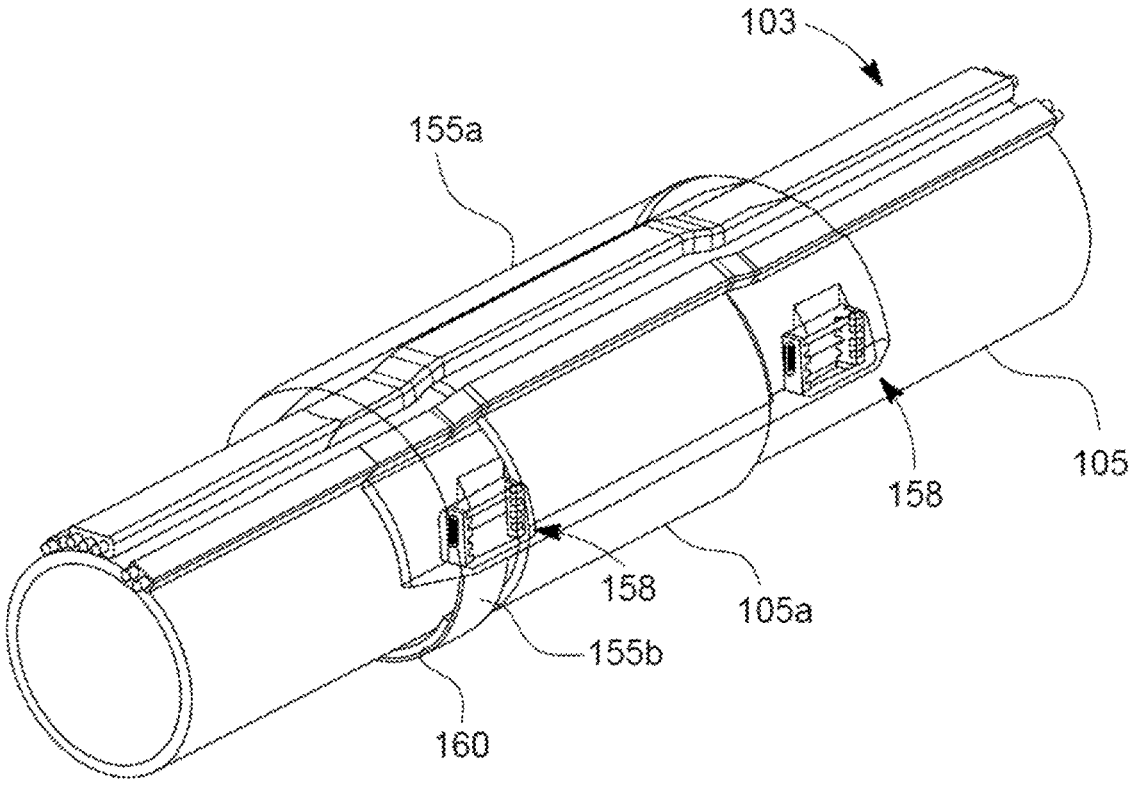

In FIG. 35, the elastic member 160 is arranged as a sheet insert between the second parts 155*b* and the pipe string 105. In FIG. 36, the elastic member 160 is arrange as an integral part of the second parts 155*b*, i.e. the elastic member 160 is provided by making a section of the second parts 155*b* elastic. The section can, for example, be made more elastic than the rest of the second parts 155*b* by providing this section made up of a different material, and/or by making this section out of thinner and more flexible material while the rest of the second parts 155*b* are made more rigid. This can, for example, be done by forming the second parts 155*b* out of a sheet metal having a section bent to a serrated profile, as illustrated in FIG. 36. In FIG. 37, the elastic members 160 are made up of disc springs integrated in the second part 155*b*. As can be seen, in FIG. 37, the clamp 155 comprises a single second part 155*b*.

The clamp 155 according to the examples illustrated in FIGS. 31-39 can be arranged for use with a control line handling apparatus 100 according to other examples or embodiments described herein, for use with other types of automatic machines for handling such clamps, or for use manually by personnel on e.g. the drill floor.

Figure 40:
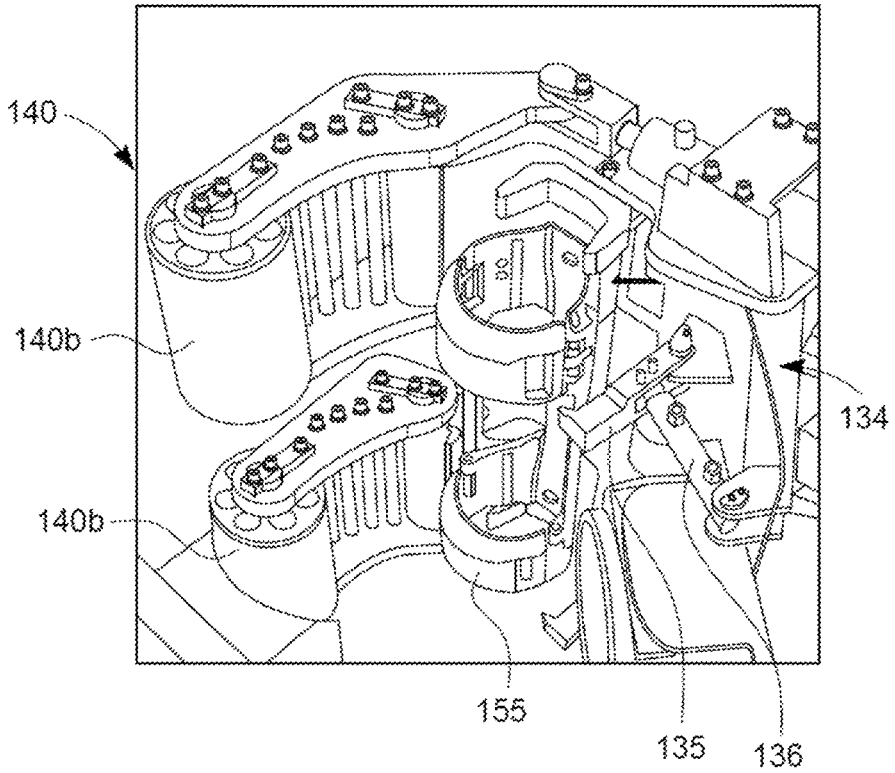
FIGS. 40-41 illustrate an example of a control line handling apparatus having a clamp unlock actuator.
Figure 41:
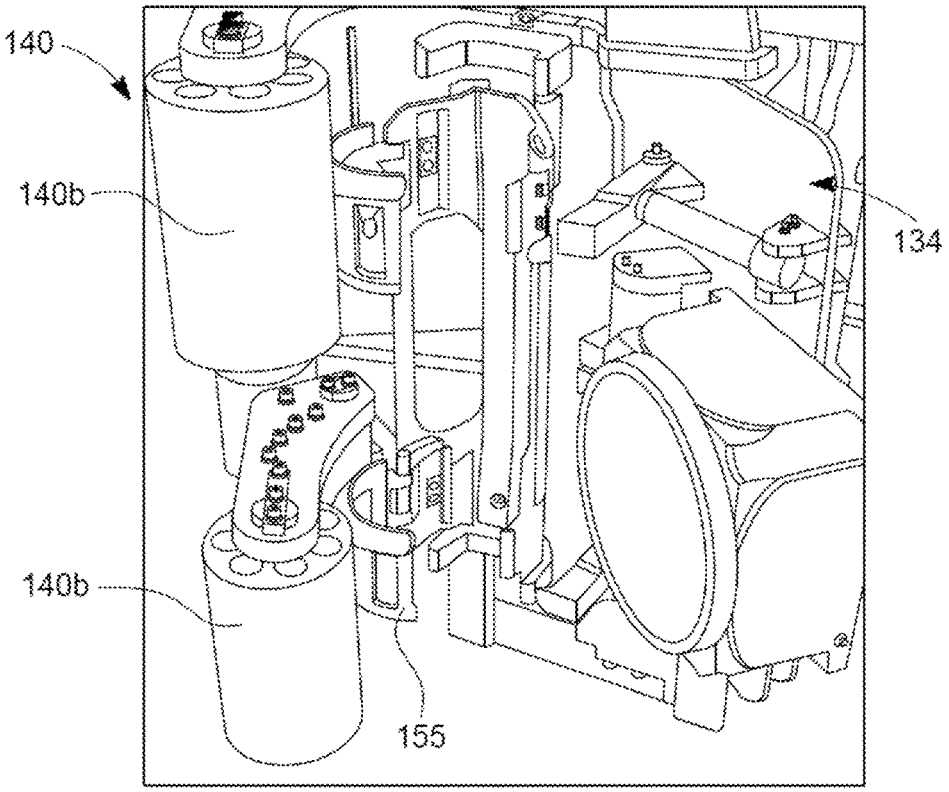

In one example, illustrated in FIG. 40, the clamp holder 134 of the control line apparatus 100 may comprise a clamp unlock actuator operable to engage a lock part 158*a,b* on a clamp 155 such as to open the clamp 155 while the clamp is in the clamp holder 134. The clamp unlock actuator may, for example, be an actuated push member 135, such as a pin or "finger" as illustrated in FIG. 40, which is operable to engage the lock part(s) 158*a,b* on the clamp 155. The push member 135 is in this example illustrated with a linear actuator 136 for activation. In this manner, the clamp 155 can be provided to the clamp holder 134 in a closed configuration (for example automatically or semi-automatically from the magazine 154, as described above) and the clamp unlock actuator be operated to open the clamp prior to engagement with the pipe string 105. Alternatively, or additionally, the clamp unlock actuator can be operated to release the clamp 155 from the pipe string 105 if/when the pipe string 105 is being pulled out of the well or the clamp 155 for other reasons needs to be removed from the pipe string 105. FIG. 40 illustrates the clamp 155 positioned in the clamp holder 134 prior to engagement by the clamp unlock actuator, while FIG. 41 illustrates the clamp 155 having been opened by the clamp unlock actuator.

Figure 42:
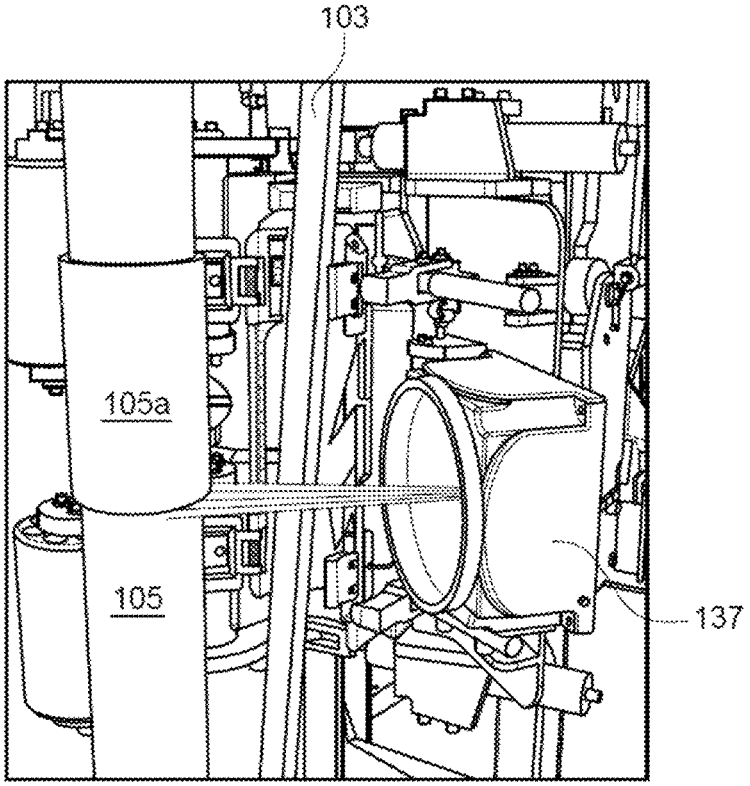
FIGS. 42-43 illustrate an example of a control line handling apparatus having a pipe string vertical position sensor.
Figure 43:
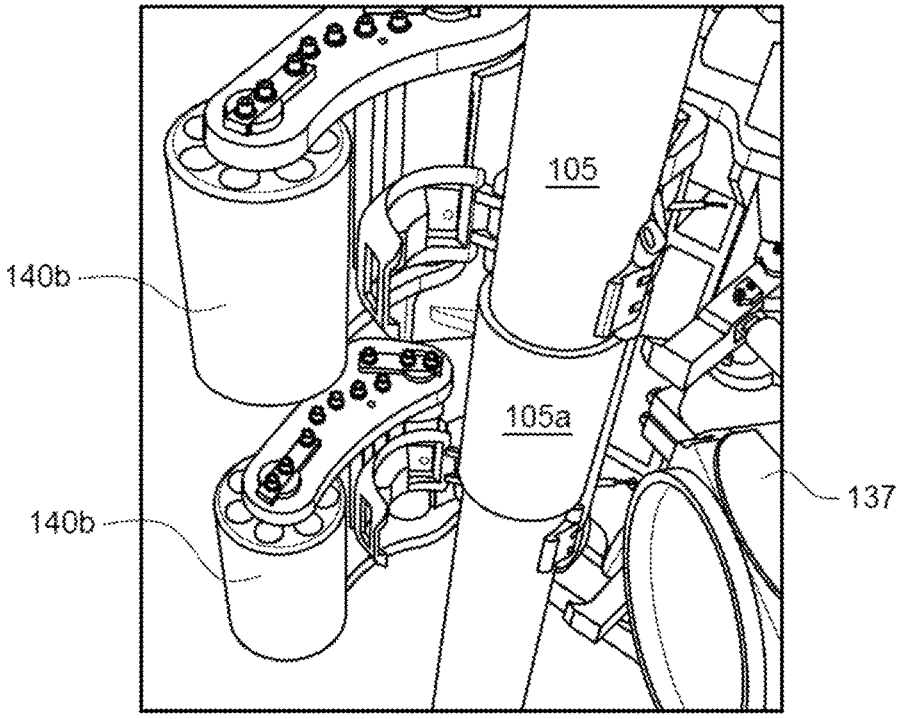

FIG. 42 illustrates a further example, wherein the control line handling apparatus 100 comprises a sensor 137 operable to identify a vertical position of a tool joint 105*a*. The sensor 137 may, for example, be an optical sensor operable to identify a width difference between the tool joint 105*a* and the rest of the pipe string 105, and thereby be able to determine whether the clamp holder 134 is at a correct vertical position relative to the pipe string 105. The sensor 137 is advantageously arranged on the clamp holder 134 and directly adjacent the pipe string 105 when the clamp holder 134 is moved towards the pipe string 105, but may optionally be placed at a different location in the apparatus 100. Having identified the vertical position of the tool joint 105*a* via the sensor 137, an operator or an automatic controller may, for example, determine that the clamp 155 can be moved towards and into engagement with the pipe string 105. Alternatively, the sensor 137 can provide information to adjust the height of the clamp holder 134, either automatically or manually, before bringing the clamp 155 into engagement with the pipe string 105. Such height (vertical) adjustment can, for example, be done via an actuator 133, described above in relation to FIG. 14. FIG. 43 illustrates the clamp 155 having been brought into engagement with the pipe string 105 and ready for closing via closing members 140*b*.

The following numbered clauses outline further embodiments and inventive aspects according to the present disclosure:

1. A control line handling apparatus (100) comprising:
   a base (101),
   a guide head (102) which is movable in relation to the base (101),
   the movable guide head (102) comprising at least one guide slot (104) for guiding a control line (103).

2. The control line handling apparatus (100) of any preceding clause, wherein the guide head (102) is configured to be movable between a first, retracted position in which the guide head (102) is spaced from a pipe string (105) extending vertically into a well and a second, advanced position in which the guide head (102) is positioned adjacent the pipe string (105), preferably wherein the guide head (102) is positioned in contact with the pipe string (105).

3. The control line handling apparatus (100) of any preceding clause, comprising an actuator arm (106) operable to move the guide head (102) in relation to the base (101), particularly wherein the actuator arm (106) is operable to move the guide head (102) between the first, retracted position and the second, advanced position.

4. The control line handling apparatus (100) of any preceding clause, wherein the actuator arm (106) is:
   telescopically extendable,
   rotatable about a pivotable connector (108) fixing the arm (106) to the base (101), or
   both telescopically extendable and rotatable about the pivotable connector (108).

5. The control line handling apparatus (100) of any preceding clause, wherein the pivotable connector (108) is vertically movable in relation to the base (101).

6. The control line handling apparatus (100) of any preceding clause, wherein the pivotable connector (108) is arranged vertically higher than the guide head (102), particularly wherein the pivotable connector (108) is arranged to be vertically higher than the guide head (102) in both the guide head's first, retracted position and its second, advanced position.

7. The control line handling apparatus (100) of any preceding clause, wherein the pivotable connector (108) is arranged vertically higher than the guide head (102) in the guide head's first, retracted position and vertically level with the guide head (102) in the guide head's second, advanced position.

8. The control line handling apparatus (100) of any preceding clause, wherein the guide head (102) comprises a receptacle (109) configured for receiving the pipe string (105), preferably wherein the receptacle (109) is a U-shaped or V-shaped recess for receiving the pipe string (105) therein.

9. The control line handling apparatus (100) of any preceding clause, wherein the actuator arm (106) comprises a parking position, optionally wherein in the parking position the actuator arm (106) is arranged vertically and positioned along and adjacent the base (101) or the guide tower (120).

10. The control line handling apparatus (100) of any preceding clause, wherein in the parking position the guide head (102) is positioned in a third position which is spaced from the first and second positions.

11. The control line handling apparatus (100) of any preceding clause, wherein the actuator arm (106) has an operational position which is substantially horizontal or horizontal, particularly wherein the actuator arm (106) is arranged substantially horizontally when the guide head (102) is in its second, advanced position.

12. The control line handling apparatus (100) of any preceding clause, wherein the actuator arm (106) is operable to move the guide head (102) between the first, retracted position and the second, advanced position horizontally and while the actuator arm (106) is arranged in the operational position which is substantially horizontal or horizontal.

13. The control line handling apparatus (100) of any preceding clause, further comprising a guide tower (120) comprising at least one line guide member (121) arranged at an upper part thereof.

14. The control line handling apparatus (100) of any preceding clause, wherein the guide tower (120) extend vertically upwardly from the base (101).

15. The control line handling apparatus (100) of any preceding clause, wherein the guide tower (120) is integral with the base (101).

16. The control line handling apparatus (100) of any preceding clause, wherein the guide tower (120) is extendible in a vertical direction, particularly wherein the guide tower (120) is telescopically extendible in the vertical direction.

17. The control line handling apparatus (100) of any preceding clause, wherein the actuator arm (106) is fixed to the guide tower (120), alternatively wherein the actuator arm (106) is fixed to the base (101) separate from the guide tower (120).

18. The control line handling apparatus (100) of any preceding clause, wherein the guide tower (120) or the base (101) comprises a platform (122) on which the at least one line guide member (121) is arranged, and/or on which an operator (125) can access the at least one line guide member (121).

19. The control line handling apparatus (100) of any preceding clause, wherein the at least one guide member (121) is arranged vertically higher than the guide head (102).

20. The control line handling apparatus (100) of any preceding clause, wherein the at least one guide member (121) comprises at least one sheave, particularly wherein the at least one guide member (121) comprises at least one sheave having a curved portion for guiding the control line (103) along a plurality of rollers arranged at the curved portion.

21. The control line handling apparatus (100) of any preceding clause, wherein the at least one guide member (121) comprises a brake (124) or drive mechanism operable to provide a tensioning force onto the control line (103).

22. The control line handling apparatus (100) of any preceding clause, wherein the brake (124) or drive mechanism is configured to maintain a substantially constant tension force in the control line(s) (103).

23. The control line handling apparatus (100) of any preceding clause, wherein the at least one guide member (121) is height-adjustable relative to the base (101).

24. The control line handling apparatus (100) of any preceding clause, wherein the at least one guide member (121) is connected to the guide tower (120) via a guide member connector (123*a,b*) which provides a pivotable connection about a vertical axis.

25. The control line handling apparatus (100) of any preceding clause, comprising a clamp support head (130) arranged on a clamp head arm (131), the clamp head arm (131) being movable between a first, retracted position in which the clamp support head (130) is spaced from the pipe string (105) and a second, advanced position in which the clamp support head (130) is positioned adjacent the pipe string (105).

26. The control line handling apparatus (100) of any preceding clause, wherein the clamp support head (130) comprises a clamp holder (134), the clamp holder (134) arranged for holding a clamp (134) and carrying the clamp (134) for engagement with the pipe string (105) in the second position.

27. The control line handling apparatus (100) of any preceding clause, wherein the clamp support head (130) comprises a clamp actuator (140), the clamp actuator (140) arranged for providing a closing force on the clamp in the second position to close the clamp on the pipe string (105).

28. The control line handling apparatus (100) of any preceding clause, wherein the clamp actuator (140) comprises a movable closing member (140*b*) operable to engage the clamp (155) and push the clamp (155) to a closed position, for example wherein the movable closing member (140*b*) is a pivotable closing member (140*b*).

28. The control line handling apparatus (100) of any preceding clause, wherein the clamp actuator arm (131) is movable independently of the actuator arm (106).

30. The control line handling apparatus (100) of any preceding clause comprising a connector (132*a,b*) having a first connector part (132*a*) arranged on the clamp support head (130) and a second connector part (132*b*) arranged on the guide head (102), the first and second parts (132*a,b*) being selectively connectable such as to mechanically connect the clamp support head (130) to the guide head (102).

31. The control line handling apparatus (100) of any preceding clause, wherein the clamp head arm (131) comprises a pantograph or scissor mechanism for horizontal movement of the clamp head arm (131) between the first and second positions.

32. The control line handling apparatus (100) of any preceding clause, wherein the clamp head arm (131) is movable in a horizontal direction, or only in a horizontal direction, between the first and second positions.

33. The control line handling apparatus (100) of any preceding clause, wherein the clamp head arm (131) is operable to move independently of the actuator arm (106) over part of a distance between the first and second positions, and to move in unison with the guide head (102) over a part of the distance between the first and second positions.

34. The control line handling apparatus (100) of any preceding clause, wherein the clamp support head (130) is movable vertically in relation to the clamp head arm (131), particularly wherein the control line apparatus (100) comprises an actuator (133) operable to move the clamp support head (130) vertically in relation to the clamp head arm (131).

35. The control line handling apparatus (100) of any preceding clause, wherein the clamp head arm (131) is fixed to the guide tower (120).

36. The control line handling apparatus (100) of any preceding clause, comprising a clamp (155) held in the clamp holder (134).

37. The control line handling apparatus (100) of any preceding clause, wherein the clamp (155) comprises a first part (155*a*) held by the clamp holder (134) and at least one second part (155*b*) connected to the first part (155*a*) via a hinge.

38. The control line handling apparatus (100) of any preceding clause, wherein the clamp (155) comprises two vertically spaced second parts (155*b*), each connected to the first part (155*a*) via a hinge.

39. The control line handling apparatus (100) of any preceding clause, wherein the at least one second part (155*b*) is supported against the clamp actuator (140) in a clamp open position and the clamp actuator (140) is operable to, via the closing member (140*b*), move the at least second part (155*b*) to bring the clamp (155) to a closed position.

40. The control line handling apparatus (100) of any preceding clause, wherein the at least one second part (155*b*) is pivotable relative to the first part (155*a*) about a vertical axis.

41. The control line handling apparatus (100) of any preceding clause, wherein the closing member (140*b*) is pivotable about a vertical axis.

42. The control line handling apparatus (100) of any preceding clause, wherein the clamp (155) comprises a biasing member, for example a spring, urging the first part (155*a*) and the at least one second part (155*b*) towards the clamp open position.

43. The control line handling apparatus (100) of any preceding clause, wherein the base (101) is configured for positioning on a deck (150) adjacent a well opening (151), preferably wherein the base (101) is configured for being removably positioned on the deck (150).

44. The control line handling apparatus (100) of any preceding clause, wherein the base (101) comprises a frame (152) or enclosure (153), and wherein the clamp head arm (131), actuator arm (106) and/or the guide tower (120) is at least partly retractable into the frame (152) or enclosure (153) in a transport configuration of the control line handling apparatus (100).

45. The control line handling apparatus (100) of any preceding clause, wherein the guide head (102) is retractable into the frame (152) or enclosure (153) in a transport configuration of the control line handling apparatus (100).

46. The control line handling apparatus (100) of any preceding clause, wherein the at least one line guide member (121) is retractable into the frame (152) or enclosure (153) in a transport configuration of the control line handling apparatus (100).

47. The control line handling apparatus (100) of any preceding clause, wherein the clamp support head (130) is retractable into the frame (152) or enclosure (153) in a transport configuration of the control line handling apparatus (100).

48. The control line handling apparatus (100) of any preceding clause, wherein the base (101) comprises a clamp magazine (154).

49. The control line handling apparatus (100) of any preceding clause, wherein the clamp support head (130) is configured for receiving a clamp (155) from the clamp magazine (154) when in the first, retracted position.

50. The control line handling apparatus (100) of any preceding clause, wherein the apparatus (100) comprises a clamp transport arm (111) operable to pick up a clamp (155) from the magazine (154) and position the clamp (155) onto or adjacent the clamp support head (130).

51. The control line handling apparatus (100) of any preceding clause, wherein the clamp support head (130) in the first, retracted position is positioned inside the frame (152) or enclosure (153).

52. The control line handling apparatus (100) of any preceding clause, wherein the clamp head arm (131) is pivotable about a vertical axis when the clamp support head (130) is in the first, retracted position, particularly wherein the clamp head arm (131) is pivotable inside the frame (152) or enclosure (153) and/or wherein the clamp head arm (131) is pivotable between a clamp pick-up position and an active position in which the clamp head arm (131) can be moved towards the second, advanced position, particularly in which the clamp head arm (131) can be linearly extended towards the second, advanced position.

53. The control line handling apparatus (100) of any preceding clause, wherein the clamp holder (134) comprises a clamp unlock actuator (135,136) operable to engage a lock part (158*a,b*) on a clamp (155) such as to open the clamp (155) while the clamp is in the clamp holder (134).

54. The control line handling apparatus (100) of any preceding clause, further comprising a sensor (137), such as a sensor (137) arranged on the clamp holder (134), operable to identify a vertical position of a tool joint (105*a*).

55. A clamp (155) for holding a control line (103) on a pipe string (105), the clamp (155) comprising:

a first part (155*a*) and at least one second part (155*b*), the at least one second part (155*b*) connected or connectable to the first part (155*a*), and a lock (158) operable to lock the first part (155*a*) to the second part (155*b*), the lock having a first lock part (158*a*) arranged on the first part (155*a*) and a second lock part (158*b*) arranged at the least one second part (155*b*).

56. The clamp (155) of any preceding clause, wherein the at least one second part (155*b*) is connected to the first part (155*a*) via a hinge (157).

57. The clamp (155) of any preceding clause, wherein the hinge (157) is arranged at a first side (161*a*) of the clamp (155) and the lock (158) is arranged on a second, radially opposite side (161*b*) of the clamp (155).

58. The clamp (155) of any preceding clause, wherein the at least one second part (155*b*) connected or connectable to the first part (155*a*) via one or more one-way lock(s), for example wherein the at least one second part (155*b*) connected or connectable to the first part (155*a*) via two one-way locks arranged on radially opposite sides (161*a-b*) of the clamp (155).

59. The clamp (155) of any preceding clause, further comprising an elastic member (160) configured for engagement with the pipe string (105).

60. The clamp (155) of any preceding clause, wherein the elastic member (160) is arranged on the at least one second part (155*b*), on each second part (155*b*) or on at least one second part (155*b*).

61. The clamp (155) of any preceding clause, wherein the elastic member (160) is arranged as part of the at least one second part (155*b*).

62. The clamp (155) of any preceding clause, wherein the elastic member (160) is arranged on the first part (155*a*).

63. The clamp (155) of any preceding clause, wherein each of the first and second parts (155*a-b*) form substantially a half-circle configured to in conjunction enclose the pipe string (105).

64. The clamp (155) of any preceding clause, wherein the elastic member (160) is a compressible member arranged at an inwardly facing part of the clamp (155).

65. The clamp (155) of any preceding clause, wherein the elastic member (160) is arranged integrally with the at least one second part (155*b*).

66. The clamp (155) of any preceding clause, wherein the elastic member (160) comprises an elastomer.

67. The clamp (155) of any preceding clause, wherein the lock (158) is a click-on lock.

68. The clamp (155) of any preceding clause, wherein the lock (158) is a one-way friction lock.

69. The clamp (155) of any preceding clause, wherein the clamp (155) comprises two vertically spaced second parts (155*b*), each connected to the first part (155*a*) via a respective hinge (157).

70. The clamp (155) of any preceding clause, wherein the clamp (155) comprises two vertically spaced second parts (155*b*) configured to engage the pipe string (105) on opposite sides of a tool joint (105*a*) on the pipe string (105).

71. The clamp (155) of any preceding clause, wherein the at least one second part (155*b*) is pivotable relative to the first part (155*a*) about a vertical axis.

72. The clamp (155) of any preceding clause, wherein the two vertically spaced second parts (155*b*) are independently pivotable relative to the first part (155*a*), preferably wherein the two vertically spaced second parts are pivotable relative to the first part (155*a*) about the same vertical axis.

73. The clamp (155) of any preceding clause, wherein the clamp (155) comprises a biasing member, for example a spring (159), urging the first part (155*a*) and the at least one second part (155*b*) towards a clamp open position.

74. The clamp (155) of any preceding clause further comprising an anti-slip insert (162), particularly wherein the anti-slip insert (162) is releasably fixed in the first part (155*a*) or the second part (155*b*).

The invention is not limited by the examples or embodiments described above; reference should be had to the appended claims.

LIST OF REFERENCE NUMERALS

100 Control line handling apparatus
101 Base
102 Guide head
103 Control line
103*a* Control line part running into guide member 121
103*b* Control line part running out of guide member 121
104 Guide slot
105 Pipe string
105*a* Tool joint
106 Actuator arm
107*a* Telescopic part
107*b* Telescopic part
108 Pivotable connector
109 Receptacle
111 Clamp transport arm
120 Guide tower
121 Guide member
122 Platform
123*a* Guide member connector
123*b* Guide member connector
124 Brake
125 Operator
129 Sheave
130 Clamp support head
131 Clamp head arm
132 Connector
132*a* First connector part
132*b* Second connector part
133 Actuator
134 Clamp holder
135 Push member
136 Linear actuator
137 Sensor
139 Rail
140 Clamp actuator
140*a* Linear actuator
140*b* Closing member
150 Deck
151 Well opening
152 Frame
153 Enclosure
154 Clamp magazine
155 Clamp
155*a* First part (of clamp 155)
155*b* Second part (of clamp 155)
156 Wheel
157 Hinge
158 Lock
158*a* First lock part
158*b* Second lock part
159 Biasing part/Spring
160 Elastic member
161*a* First side
161*b* Second, radially opposite side
162 Anti-slip insert

What is claimed is:

1. A control line handling apparatus comprising:

a base;

a guide head arranged on a guide head actuator arm, the guide head actuator arm being configured to move between a first, retracted guide head position in which the guide head is configured to be spaced from a pipe string which extends vertically into a well, and a second, advanced guide head position in which the guide head is configured to engage the pipe string, the guide head comprising at least one guide slot which is configured to guide a control line; and a clamp actuator head arranged on a clamp head arm, the clamp head arm being configured to move between a first, retracted clamp actuator head position in which the clamp actuator head is configured to be spaced from the pipe string, and a second, advanced clamp actuator head position in which the clamp actuator head is configured to engage the pipe string, wherein, the clamp head arm is configured to be linearly extendable so as to move the clamp actuator head horizontally between the first, retracted clamp actuator head position and the second, advanced clamp actuator head position.

2. The control line handling apparatus as recited in claim 1, wherein, the clamp head arm comprises a pantograph mechanism or a scissor mechanism, and the moving of the clamp actuator head horizontally between the first, retracted clamp actuator head position and the second, advanced clamp actuator head position is provided by the pantograph mechanism or by the scissor mechanism of the clamp head arm.

3. The control line handling apparatus as recited in claim 1, wherein the clamp head arm is further configured to be pivotable about a vertical axis when the clamp actuator head is in the first, retracted clamp actuator head position.

4. The control line handling apparatus as recited in claim 3, wherein the clamp head arm is pivotable between:

a first clamp head arm orientation in which the clamp actuator head is in the first, retracted clamp actuator head position, and a second clamp head arm orientation in which the clamp actuator head is in a pick-up position.

5. The control line handling apparatus as recited in claim 4, further comprising:

a clamp magazine which comprises a clamp, wherein, the clamp actuator head is further configured to receive the clamp from the clamp magazine when in the pick-up position.

6. A control line handling apparatus comprising:

a base;

a guide head arranged on a guide head actuator arm, the guide head actuator arm being configured to move between a first, retracted guide head position in which the guide head is configured to be spaced from a pipe string which extends vertically into a well, and a second, advanced guide head position in which the guide head is configured to engage the pipe string, the guide head comprising at least one guide slot which is configured to guide a control line; and a clamp actuator head arranged on a clamp head arm, the clamp head arm being configured to move between a first, retracted clamp actuator head position in which the clamp actuator head is configured to be spaced from the pipe string, and a second, advanced clamp actuator head position in which the clamp actuator head is configured to engage the pipe string, wherein, the clamp actuator head is further configured to receive the pipe string in a clamp holder which comprises an aperture for the pipe string, and the clamp actuator head comprises an actuated closing member which is configured to pivot about a vertical axis and to close on the pipe string.

7. The control line handling apparatus as recited in claim 6, wherein the clamp holder is configured to hold a clamp and to carry the clamp for an engagement with the pipe string in the second, advanced clamp actuator head position.

8. A control line handling apparatus comprising:

a base;

a guide head arranged on a guide head actuator arm, the guide head actuator arm being configured to move between a first, retracted guide head position in which the guide head is configured to be spaced from a pipe string which extends vertically into a well, and a second, advanced guide head position in which the guide head is configured to engage the pipe string, the guide head comprising at least one guide slot which is configured to guide a control line;

a clamp actuator head arranged on a clamp head arm, the clamp head arm being configured to move between a first, retracted clamp actuator head position in which the clamp actuator head is configured to be spaced from the pipe string, and a second, advanced clamp actuator head position in which the clamp actuator head is configured to engage the pipe string; and a guide tower which comprises at least one line guide member which is arranged at an upper part of the guide tower, the guide tower being fixed to and being arranged to extend upwardly from the base, wherein, the base is configured to be removably positioned on a deck adjacent a well opening, the clamp head arm and the guide head actuator arm are each further configured to be movable relative to the guide tower and relative to each other, the guide head actuator arm is further configured to rotate about a first pivotable connector which is arranged between the guide head actuator arm and the base, the first pivotable connector being configured to permit a pivoting of the guide head actuator arm about a horizontal axis so as to move the guide head between the first, retracted guide head position and the second, advanced guide head position, the clamp head arm is further configured to rotate about a second pivotable connector which is arranged between the clamp head arm and the base, the second pivotable connector being configured to permit a pivoting of the clamp head arm about a vertical axis, and the clamp head arm is configured to be linearly extendable to move the clamp actuator head horizontally between the first, retracted clamp actuator head position and the second, advanced clamp actuator head position.

9. The control line handling apparatus as recited in claim 8, wherein the first pivotable connector is further configured to be vertically movable relative to the base.

10. The control line handling apparatus as recited in claim 8, wherein the first pivotable connector is arranged vertically higher than the clamp head arm.

11. The control line handling apparatus as recited in claim 8, wherein the clamp head arm comprises a pantograph mechanism or a scissor mechanism, and the moving of the clamp actuator head horizontally between the first, retracted clamp actuator head position and the second, advanced clamp actuator head position is provided by the pantograph mechanism or by the scissor mechanism of the clamp head arm.

* * * * *